US005337822A

United States Patent [19]

Massie et al.

[11] Patent Number: 5,337,822

[45] Date of Patent: Aug. 16, 1994

[54] WELL FLUID SAMPLING TOOL

[76] Inventors: Keith J. Massie, 39 Beechgrove Terrace; Jonathan W. Brown, 20 Richmond Terrace; James A. McGilvray, 50 Rosemount Place, all of Aberdeen, United Kingdom

[21] Appl. No.: 920,380

[22] PCT Filed: Feb. 14, 1991

[86] PCT No.: PCT/GB91/00224

§ 371 Date: Aug. 17, 1992

§ 102(e) Date: Aug. 17, 1992

[87] PCT Pub. No.: WO91/12411

PCT Pub. Date: Aug. 22, 1991

[30] Foreign Application Priority Data

Feb. 15, 1990 [GB] United Kingdom ..... 9003467

[51] Int. Cl.[5] ..... E21B 49/08

[52] U.S. Cl. ..... 166/264; 166/321; 73/155

[58] Field of Search ..... 166/264, 321; 73/155, 73/64.56

[56] References Cited

U.S. PATENT DOCUMENTS

| | | | |
|---|---|---|---|
| 3,095,930 | 7/1963 | Kisling, III . | |
| 3,556,211 | 1/1971 | Bohn et al. . | |
| 3,859,850 | 1/1975 | Whitten et al. | 73/155 |
| 4,210,025 | 7/1980 | Bimond et al. | 73/421 R |
| 4,665,991 | 5/1987 | Manke | 166/321 X |
| 4,667,743 | 5/1987 | Ringgenberg et al. | 166/321 |
| 4,721,157 | 1/1988 | Berzin | 166/264 X |
| 4,766,955 | 8/1988 | Petermann | 166/264 X |
| 5,009,100 | 4/1991 | Gruber | 73/155 |

FOREIGN PATENT DOCUMENTS 2022554 6/1979 United Kingdom .

*Primary Examiner*—Ramon S. Britts
*Assistant Examiner*—Roger J. Schoeppel
*Attorney, Agent, or Firm*—Ratner & Prestia

[57] ABSTRACT

A well fluid sampling tool and method for retrieving single-phase hydrocarbon samples from deep wells. The sampling tool is lowered to the required depth, an internal sample chamber is opened to admit well fluid at a controlled rate, and the sample chamber is then automatically sealed. The well fluid sample is immediately subjected to a high pressure to keep the sample in its original single-phase form until it can be analyzed.

The sample is pressurized by a hydraulically-driven floating piston powdered by high-pressure gas acting on another floating piston. Once sampling is initiated, e.g. by an internal clock, the entire sequence is automatic.

Also disclosed is a sample transfer container for securing the pressurized sample from the tool and maintaining it in single-phase form during transport to an analytical laboratory.

This invention avoids the disadvantages arising from phase separation of hydrocarbon well fluid samples.

9 Claims, 14 Drawing Sheets

WELL FLUID SAMPLING TOOL

This invention relates to a well fluid sampling tool and to a well fluid sampling method.

Hydrocarbon fluids (oil and gas) are found in geological reservoirs wherein they are contained at a high pressure (relative to ambient atmospheric pressure), and usually also at an elevated temperature (relevant to ambient atmospheric temperature). At such pressures, the gas is dissolved in the oil such that the reservoir fluid initially exists as a single-phase. fluid, but the reservoir fluid will release dissolved gas to form a two-phase fluid with separate gas and oil components if the reservoir fluid has its initial pressure sufficiently reduced towards ambient atmospheric pressure. Also, the initial relatively high temperature of the reservoir fluid results in volumetric contraction of a given mass of fluid as it cools toward ambient atmospheric temperature if withdrawn from the well.

When hydrocarbon exploration wells are drilled and hydrocarbon fluids are found, a well fluid test is usually performed. This test usually involves flowing the well fluid to surface, mutually separating the oil and the gas in a separator, separately measuring the oil and gas flow rates, and then flaring the products.

It is also desirable to take samples of the oil and gas for chemical and physical analysis. Such samples of reservoir fluid are collected as early as possible in the life of a reservoir, and are analysed in specialist laboratories. The information which this provides is vital in the planning and development of hydrocarbon fields and for assessing their viability and monitoring their performance.

There are two ways of collecting these samples:

1. Bottom Hole Sampling of the fluid directly from the reservoir, and
2. Surface Recombination Sampling of the fluid at the surface.

In Bottom Hole Sampling (BHS) a special sampling tool is run into the wall to trap a sample of the reservoir fluid present in the well bore. Provided the well pressure at the sampling depth is above the "Bubble Point Pressure" of the reservoir fluid, all the gas will be dissolved in the oil, and the sample will be a single-phase fluid representative of the reservoir fluid, i.e. an aliguot.

Surface Recombination Sampling (SRS) involves collecting separate oil and gas samples from the surface production facility (e.g. from the gas/oil separator). These samples are recombined in the correct proportions at the analytical laboratory to create a composite fluid which is intended to be representative of the reservoir fluid, i.e. a re-formed aliquot.

Several BHS tools are currently available commercially, which function by a common principle of operation.

A typical BHS tool is run into the well to tap a sample of reservoir fluid at the required depth by controlled opening of an internal chamber to admit reservoir fluid, followed by sealing of the sample-holding chamber after admission of predetermined volume of fluid. The tool is then retrieved from the well and the sample is transferred from the tool to a sample bottle for shipment to the analytical laboratory. As the tool is retrieved from the well, its temperature drops and the fluid sample shrinks causing the sample pressure to drop. This pressure drop occurs because the sample-holding chamber within the typical BHS tool has a fixed volume after the sample is trapped. Usually the sample pressure falls below the Bubble Point Pressure, allowing gas to break out of solution. This means the sample is now in two phases, a liquid phase and a gas phase, instead of in single-phase form as it was before the pressure dropped. In order successfully to transfer the sample from the tool to the sample bottle, it is necessary to re-pressurise the sample sufficiently to force the free gas back into solution, recreating a single-phase sample. This recombination is a lengthy procedure and thus expensive.

The phase changes which the sample experiences may also cause the precipitation of compounds previously dissolved in the well fluid, some of which cannot be re-dissolved by re-pressurisation. The absence of these compounds in the re-formed aliquot renders certain analyses meaningless.

A means by which a well fluid sample could be collected, retrieved and transferred in single-phase form, without a pressure-induced phase change, would mitigate these problems. Not only would time spent recombining two-phase sample back to single phase be saved, but pressure-sensitive compounds would remain dissolved, allowing more accurate analyses to be performed on the sample.

According to a first aspect of the present invention there is provided a well fluid sampling tool comprising a variable-volume sample chamber and pressurisation means for pressurising a well-fluid sample held within said sample chamber to maintain said well fluid sample in single-phase form.

Said pressurisation means preferably comprises a reservoir of compressed gas.

Said tool preferably comprises valve means for controlling admission of well fluid into said sample chamber and for subsequently applying pressurisation thereto.

Said sample chamber is preferably provided with a variable volume by forming one end of said sample chamber as a floating piston subjected, in use of the tool, on one side thereof to the pressure of sampled well fluid and on the other side thereof to the pressure of said pressurisation means.

According to a second aspect of the present invention there is provided a well fluid sampling tool, said tool comprising a first cylinder, said first cylinder containing a first floating piston and a limit valve disposed at mutually different locations along the longitudinal axis of said first cylinder, said first floating piston being slidingly sealed to said first cylinder, said limit valve being movable by contact with said first floating piston between an open condition and a closed condition, said first floating piston and said limit valve dividing said first cylinder into a sample chamber having a variable internal volume, a dashpot chamber, and a pressurisation chamber intermediate said sample chamber and said dashpot chamber, adjacent ends of said sample chamber and said pressurisation chamber being defined by said first floating piston, adjacent ends of said pressurisation chamber and said dashpot chamber being defined by said limit value, said first floating piston being bi-directionally movable along said first cylinder under the influence of the difference between fluid pressure in said sample chamber and fluid pressure in said pressurisation chamber, said sample chamber having a well fluid inlet port at an end of said sample chamber remote from said pressurisation chamber for admission of a sample of well fluid to said sample chamber, a well fluid sample inlet valve controllably movable selectively to open or close said inlet port, a second cylinder containing a second floating piston slidingly sealed thereto and dividing said second cylinder into a pressure transmitting chamber and a pressurisation reservoir for containing an elastic pressurisation source, a pressurisation control valve linking said second pressure transmitting chamber in said cylinder to said pressurisation chamber in said first cylinder, said limit valve, said inlet valve, and said pressurisation control valve being mutually linked for conjoint cascade operation, a regulator valve for controllably discharging fluid from said dashpot chamber, and regulator valve control means for actuating said regulator valve substantially at a predetermined time, whereby in operation of said tool wherein said tool is primed for well fluid sampling operation by said regulator valve being closed, said limit valve being opened to link said dashpot chamber and said pressurisation chamber, said inlet valve being opened, said pressurisation control valve being closed, said first floating piston being located in said first cylinder to be adjacent said well fluid inlet port to initialise the sample chamber volume at a minimum, said pressure transmitting chamber and said initially linked dashpot and pressurisation chambers each being substantially filled with a substantially incompressible hydraulic fluid, and said pressurisation reservoir being charged with an elastic pressurisation source having an initial pressure at least equal to the pressure of well fluid to be sampled, then when said tool is lowered down a well to a location where well fluid is to be sampled and upon said regulator valve control means opening said regulator valve controllably to discharge said hydraulic fluid from said dashpot chamber, the inherent pressure of reservoir fluid in said well causes well fluid to enter said sample chamber through said inlet port and so displace said first floating piston to accommodate incoming well fluid by enlarging the internal volume of said sample chamber at a rate controlled by the discharge of said hydraulic fluid from said pressurisation chamber through said limit valve, said dashpot chamber and said regulator valve, until said first floating piston reduces the internal volume of said pressurisation chamber to a minimum and contacts said limit valve to close said limit valve, then close said inlet valve and complete the intake of well fluid to said sample chamber, complete discharge of hydraulic fluid from said dashpot chamber and open said pressurisation control valve such that said elastic pressurisation source is now coupled through said second floating piston and the hydraulic fluid in said pressure transmitting and pressurisation chambers to apply pressurisation to said first floating piston in a manner tending to counteract thermal shrinkage of the sampled well fluid during cooling thereof by corresponding reduction of the internal volume of said sample chamber arising from pressurisation-induced movement of said first floating piston, to maintain said sampled well fluid in single-phase form.

Said elastic pressurisation source preferably is in the form of a compressed gas, the gas preferably being nitrogen.

The tool preferably comprises an air chamber linked through said regulator valve to said dashpot chamber, said air chamber receiving said hydraulic fluid discharged through said regulator valve from said dashpot chamber in use of said tool.

Said regulator valve control means may comprise any suitable arrangement for opening said regulator valve substantially at a predetermined time, for example a signal receiving means for receiving an actuating signal transmitted at the time of sampling from the surface above the well whose fluid is being sampled, but said regulator valve control means preferably comprises a clock or other timing device comprised within the tool and presettable at the surface prior to downwell deployment of the initialised tool.

Said limit valve is preferably in the form of an annular member and a plug member, said annular member being slidingly sealed to said first cylinder, said annular member being initially located in said first cylinder between said first floating piston and said plug member, said annular member being movable by contact with said first floating piston into sealed contact with said plug member to close said limit valve. Said plug member is preferably linked through a link member to said inlet valve and to said pressurisation control valve to provide said mutual linkage thereof for conjoint cascade operation, said link member forming a combined mechanical force transmitting linkage and hydraulic conduit, said hydraulic conduit hydraulically linking said pressurisation control valve and said pressurisation chamber.

Said pressurisation control valve is preferably in the form of a pressure-balanced spool valve.

According to a third aspect of the present invention there is provided a well fluid sampling method, said method comprising the steps of providing a well fluid sampling tool comprising a sample chamber, lowering said tool down a well to a location where well fluid is to be sampled, admitting a sample of well fluid into said sample chamber and then sealing said sample chamber, and applying pressurisation to said sample in a manner tending to counteract thermal shrinkage of the sampled well fluid during cooling thereof while raising of the tool and sample up the well, to maintain said sampled well fluid in single-Phase form.

Said method preferably comprises the steps of providing said tool in a form wherein said sample chamber has a variable internal volume, and applying pressurisation to said sample in a manner tending to reduce the internal volume of said sample chamber.

Said pressurisation is preferably applied by hydraulically transmitting the internal pressure of a reservoir of compressed gas comprised within said tool.

According to a fourth aspect of the present invention there is provided a well fluid sample transfer container for transferring a single-phase well fluid sample obtained by use of the well fluid sampling tool according to the first or third aspects of the present invention or by use of the well fluid sampling method according to the second aspect of the present invention, said container comprising a sample chamber having a variable internal volume defined at one end thereof by a first floating piston, a pressurisation reservoir having a variable internal volume defined at one end thereof by a second floating piston, the variable volume intermediate said first and second floating pistons constituting a pressure transmitting volume, externally controllable hydraulic fluid inlet/outlet valve means connected with said pressure transmitting volume for controlled admission and discharge of a substantially incompressible hydraulic fluid to or from said pressure transmitting volume in use of said container, externally controllable sampled well fluid inlet/outlet valve means connected with said sample chamber at an end thereof remote from said end defined by said first floating piston for controlled admission and discharge of sampled well fluid to or from said sample chamber in use of said container, and externally controlled elastic pressurisation fluid inlet/outlet valve means connected with said pressurisation reservoir at an end thereof remote from said end defined by said second floating piston for controlled admission and discharge of elastic pressurisation fluid to or from said pressurisation reservoir in use of said container.

Said first and second floating pistons may both be contained in and slidingly sealed to a common cylinder comprised in said container or, alternatively, said first and second floating pistons may each be contained in and slidingly sealed to a respective cylinder, both said cylinders being comprised in said container and mutually hydraulically linked.

Said sample chamber preferably contains a sample agitator, which may comprise an annulus axially movable within said sample chamber, said annulus and said first floating piston preferably being shaped and dimensioned for mutual nesting substantially without intervening volume to minimise dead volume of said sample chamber as the internal volume of said sample chamber is reduced to a minimum.

Embodiments of the invention will now be described by way of example, with reference to the accompanying drawings wherein:

FIGS. 1–5 schematically depict a first embodiment of well fluid sampling tool in accordance with the invention, in various successive stages of its utilisation;

Figure 16:
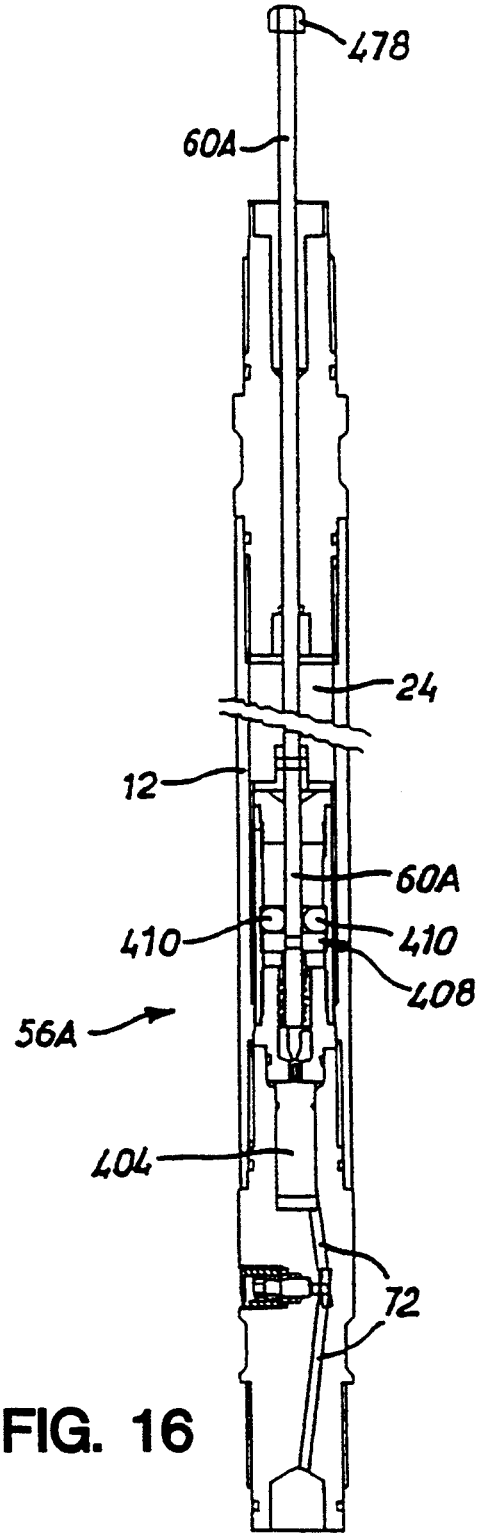
FIG. 16 is a longitudinal section of a modified form of a regulator valve and its actuating/release mechanism.
Figure 17:
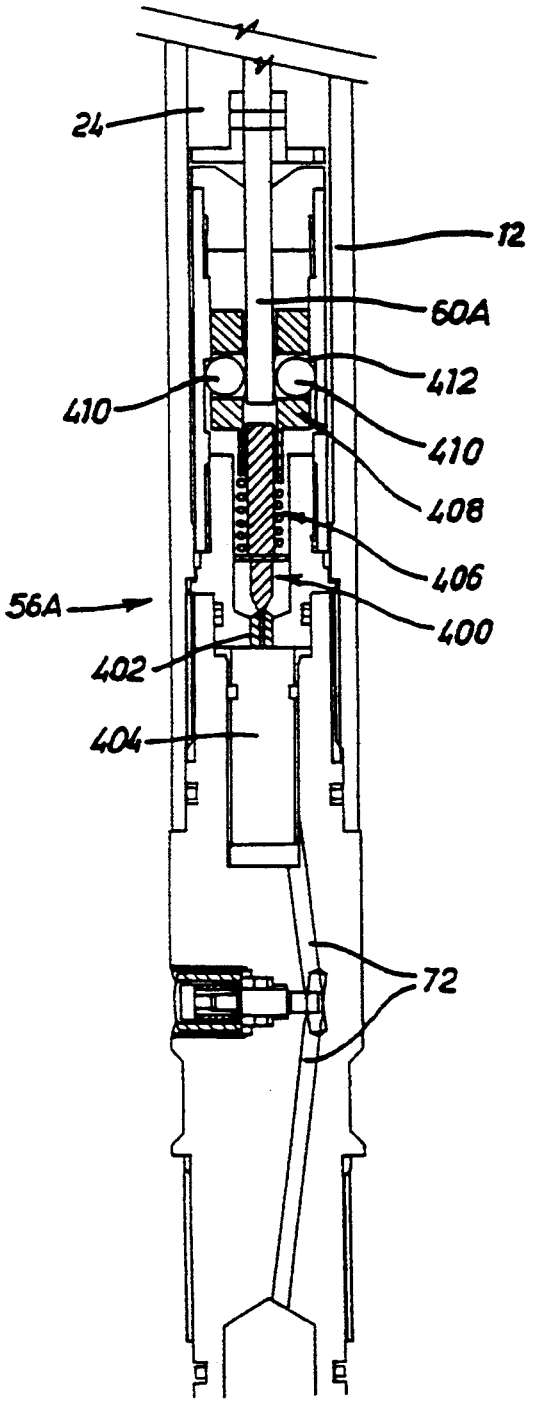

FIG. 17 repeats the lower part of FIG. 16 to an enlarged scale; and

Figure 18:
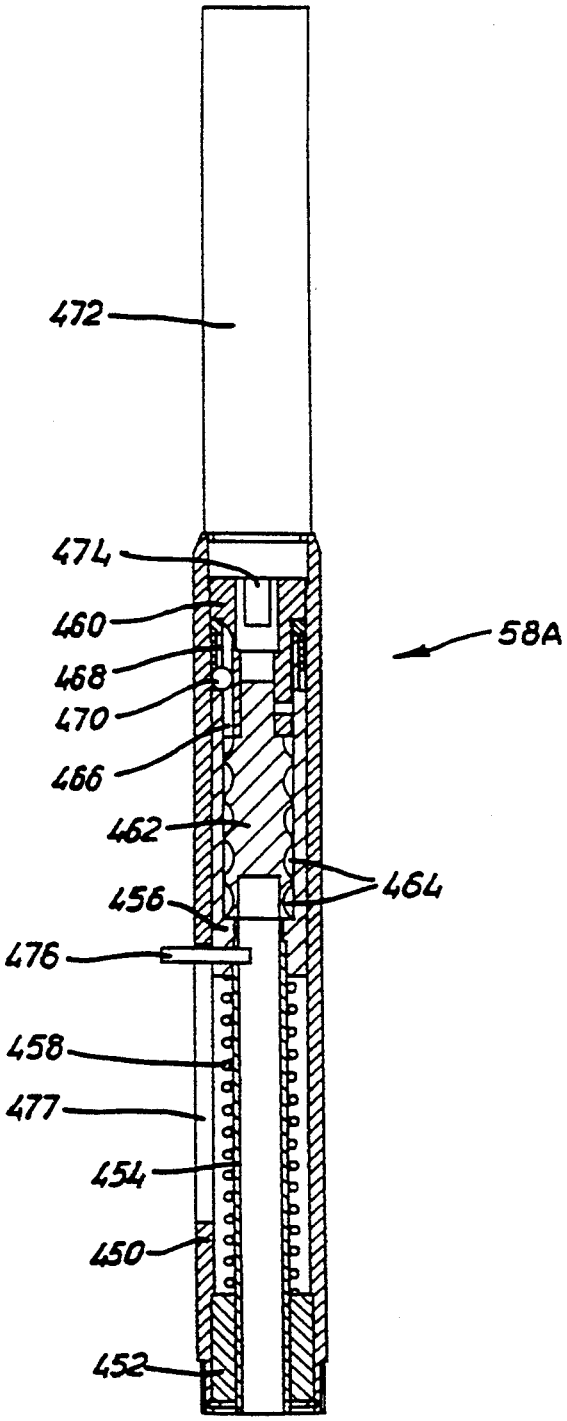

FIG. 18 is a longitudinal section of a modified clock mechanism.

Figure 1:
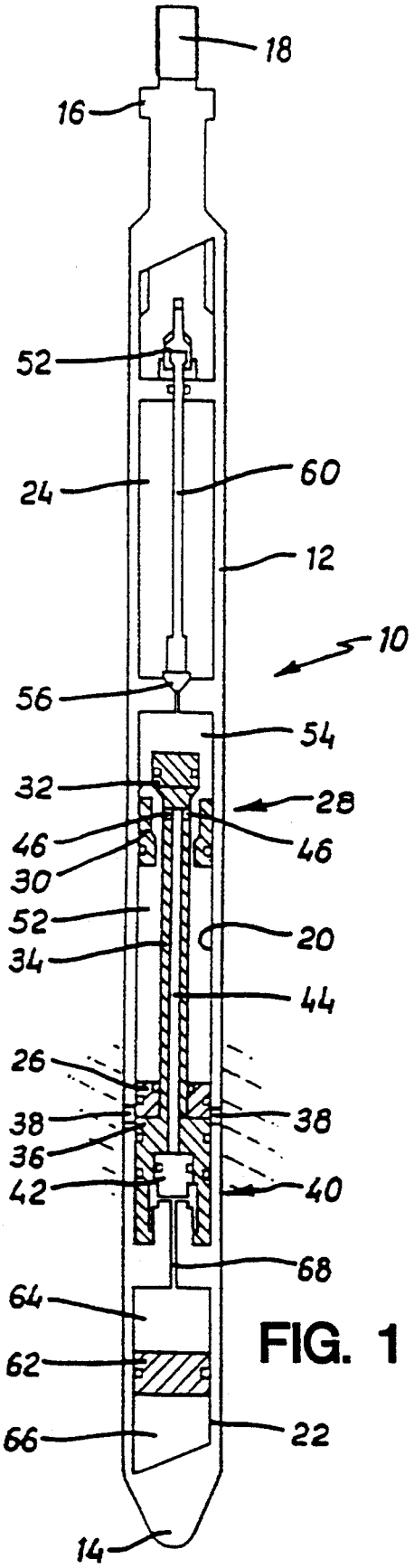

Referring first to FIG. 1 (and cross-referring to FIGS. 2–5 where noted), this schematically depicts a first embodiment of well fluid sampling tool 10 in accordance with the present invention, the tool 10 being shown in FIG. 1 in its initialised state ready for deployment downwell.

The tool 10 comprises an elongated and externally cylindrical casing 12 formed at its lower end with a tapered nose 14. The upper end of the casing 12 is formed with a fishing neck 16 and a screw-threaded coupling half 18 by which the tool 10 may be attached to a wireline (not shown) or other suitable means for lowering and raising the tool 10 in a hydrocarbon well whose fluid is to be sampled.

The tool casing 12 is hollow and has various internal cavities which respectively define a first cylinder 20, a second cylinder 22, and an air chamber 24.

Figure 3:
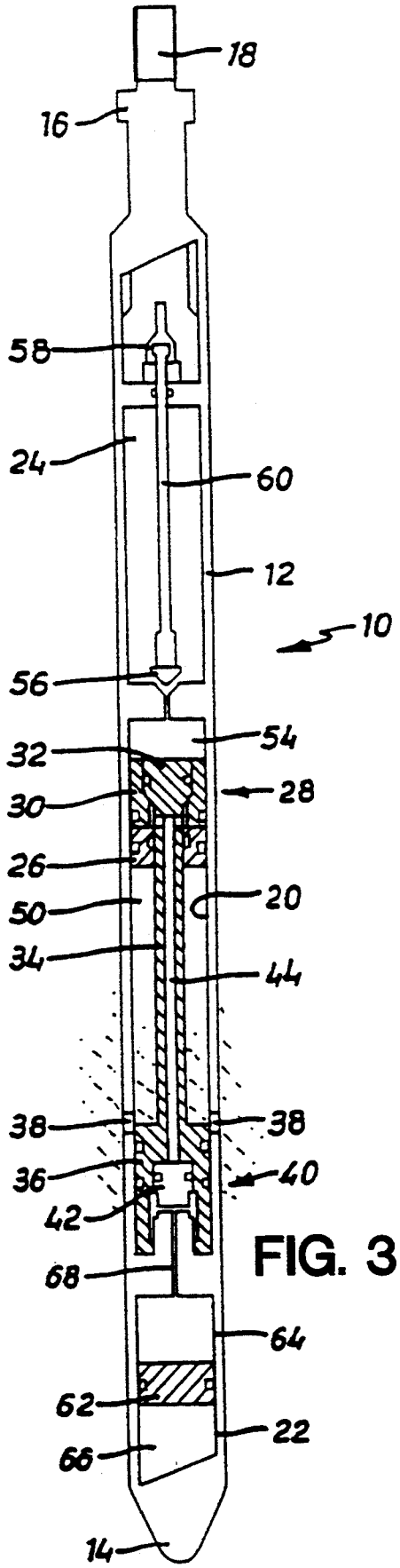

The first cylinder 20 is longitudinally divided by a first floating piston 26 and a limit valve assembly 28. The term "limit valve" is used by analogy with the term "limit switch" for an electromechanical switch assembly whose state (electrically closed/electrically open) is changed over by mechanical contact with a moving article. In the tool 10, the limit valve assembly 28 comprises an annular valve member 30 and a plug valve member 32. The annular valve member 30 is slidingly sealed to the bore of the first cylinder 20. When the annular valve member 30 is moved up the first cylinder 20 (in a manner detailed below) to encircle the plug members 32 ( as subsequently depicted in FIG. 3), the valve member 30 and 32 become mutually sealed to close off the bore of the cylinder 20. The limit valve assembly 28 is thus changed over from its hydraulically open state as shown in FIG. 1 to its hydraulically closed state as shown in FIG. 3. (The function of the limit valve assembly 28 in use of the tool 10 will be detailed subsequent to the following description of the remaining structure of the tool 10).

A hollow tubular pull-rod 34 extends down the axis of 34 the first cylinder 20 from the plug valve member 32 to a sample inlet control valve member 36. The tool casing 12 has a ring of well fluid inlet ports 38 near the lower end of the first cylinder 20, and admission of well fluid in through these ports 38 can be shut off by raising the inlet control valve member 36 from its inlet-opening position shown in FIGS. 1 and 2 to its inlet-closing position shown in FIGS. 3 and 4 (as will subsequently be detailed).

The inlet control valve member 36 is hollow and forms the annular armature of a pressurisation control valve 40 having a central static spool 42 set in the lower end of the first cylinder 20 for a purpose to be detailed below.

The pull-rod 34 mechanically links the limit valve assembly 28 with the inlet control valve member 36 (and hence with the pressurisation control valve 40) for conjoint cascade operation in a manner detailed below. The hollow bore 44 of the pull-rod 34 hydraulically links one side (the upper end) of the pressurisation control valve 40 (within the hollow dual-function valve member 36) to lateral ports 46 immediately below the plug valve member 32 for a purpose detailed below.

The first floating piston 26 has the form of an annulus in order to accommodate the pull-rod 34, and is slidingly sealed both to the exterior of the pull-rod 34 and to the bore of the first cylinder 20.

The first cylinder 20 is longitudinally divided into three variable-volume chambers by means of the first floating piston 26 and the limit valve assembly 28, as will now be detailed.

A variable-volume sample chamber 50 is defined between the underside of the first floating piston 26 and the upper end of the inlet control valve member 36 (which is effectively level with the inlet ports 38 when the valve member 36 is in its inlet-opening condition). The variable-volume sample chamber 50 is shown with its internal volume substantially zero in FIG. 1, at a maximum in FIG. 4, and at two different intermediate values in FIGS. 2, 3, and 5.

A variable-volume pressurisation chamber 52 is defined between the topside of the first floating piston 26 and the limit valve assembly 28. The variable-volume pressurisation chamber 52 is shown with its internal volume at a maximum value in, FIG. 1, substantially zero in FIGS. 3 and 4, and at two different intermediate values in FIGS. 2 and 5.

A variable-volume dashpot chamber 54 is defined between the limit value assembly 28 and the upper end of the first cylinder 20. The variable-volume dashpot chamber 54 is shown with its internal volume at a maximum value in FIGS. 1 and 2, substantially zero in FIGS. 4 and 5, and at an intermediate value in FIG. 3.

The pressurisation chamber 52 and the dashpot chamber 54 are mutually hydraulically linked when the limit valve assembly 28 is hydraulically open, i.e. when the valve members 30 and 32 are mutually separated as shown in FIG. 1. The chambers 52 and 54 are mutually hydraulically isolated when the limit valve assembly 28 is hydraulically closed, i.e. when the valve members 30 and 32 are mutually conjoined and Sealed as shown in FIG. 3.

Within movement end limits defined by the limit valve assembly 28 and the inlet control valve member 36, the first floating piston 26 will move up and down the first cylinder 20 in accordance with the difference in pressure in the sample chamber 50 (tending to drive the piston 26 upwards) and the pressure in the pressurisation chamber 52 (tending to drive the piston 26 downwards). Provided movement of the first floating piston 26 is not contained, the piston 26 will tend to take up a position along the first cylinder 20 in which the pressures in the chambers 50 and 52 are mutually lo substantially equal, as will be particularly described below with reference no FIG. 5.

The top of the first cylinder 20 is linked to the air chamber 24 through a regulator valve 56 which is depicted in its closed position in FIG. 1 and can be opened to allow controlled discharge of hydraulic fluid from the dashpot chamber 54 into the air chamber 24, as will be detailed below. Opening of the regulator valve 56 at a predetermined time is controlled by a clock (or other suitable timing mechanism) 58 mounted inside the tool casing 12 above the air chamber 24. The clock 58 is linked to the regulator valve 56 by means of a pull-rod 60 slidingly sealed to the casing 12 where it passes into the air chamber 24.

The second cylinder 22 contains a second floating piston 62 which is slidingly sealed to the bore of the cylinder 22. The second floating piston 62 divides the second cylinder into a pressure transmitting chamber 64 and a pressurisation reservoir 66. The pressure transmitting chamber 64 is linked to the central static spool 42 of the pressurisation control valve 40 by means of a conduit 68.

Within movement end limits defined by the opposite ends of the second cylinder 22, the second floating piston 62 will move up and down the cylinder 22 to tend to egualise pressures in the pressure transmitting chamber 64 and in the pressurisation reservoir 66.

Having now completed a description of the essential structure of the well fluid sample tool 10, the next section of the description refers to the initialisation of the tool 10 in readiness for well-fluid-sampling downhole deployment, and is followed by a description of such use.

The inlet control valve member 36 is lowered to open the well fluid inlet ports 38 and to close the pressurisation control valve 40 so hydraulically isolating the pressurisation chamber 52 from the pressure transmitting chamber 64. The first floating piston 26 is lowered to abut the topside of the inlet control valve member 36 and so reduce the initial internal volume of the sample chamber 50. The annular limit valve member 30 is lowered clear of the limit valve plug member 32, so hydraulically opening the limit valve assembly 28 and hydraulically linking the pressurisation chamber 52 with the dashpot chamber 54. The clock 58 is initialised to lower the pull-rod 60 and to close the regulator valve 56, so isolating the dashpot chamber 54 from the air chamber 24.

The initially linked pressurisation chamber 52 and dashpot chamber 54 together with the pull-rod bore 44, are filled with a substantially incompressible working fluid, such as hydraulic oil. The pressure transmitting chamber 64 and the conduit 68 are also filled with the same hydraulic oil or other working fluid. The pressurisation reservoir 66 is charged with an elastic source of pressurisation energy, which is preferably highly compressed gaseous nitrogen at an initial pressure exceeding the expected pressure of well fluid to be sampled. (The consequent pressure in the oil-filled pressure transmitting chamber 64 transmitted thereto by the second floating piston 62 is isolated from the pull-rod bore 44 by the initially closed pressure-balanced pressurisation control spool valve 40). By contrast, the air chamber 24 contains only air (or any other suitable gas) at a relatively low pressure, conveniently at ambient atmospheric pressure.

The above described initialisation of the valves and other components of the tool 10 is depicted in FIG. 1. Not shown in FIGS. 1–5 are valve-controlled ports in the tool casing 12 for enabling appropriate parts of the tool 10 to be charged with oil and gas, but such ports and their control valves are shown in and will be described below with reference to FIG. 6.

With the clock 58 present to lift the pull-rod 60 (or to allow the pull-rod 60 to lift) and so open the regulator valve 56 after a predetermined lapse of time equal to the expected time to deploy the initialised sampling tool to its sampling location down a well, plus an appropriate margin, a wireline or other suitable tool deploying means (not shown) is attached to the coupling 18, and the initialised sampling tool 10 (FIG. 1) is thereby lowered down the well to a downhole location whereat the well fluid is to be sampled.

With the initialised tool 10 in its downhole sampling location and immediately prior to commencement of well fluid sampling, the ambient pressure of well fluid acting through the inlet parts 38 will tend to force the first floating piston upwards within the first cylinder 20, but such upward movement of the piston 26 is initially inhibited by the hydraulic oil filling the linked pressurisation and dashpot chambers 52 and 54 because this oil is initially denied any escape therefrom owing to the regulator and pressurisation control valves 56 and 40 being both initially closed.

Figure 2:
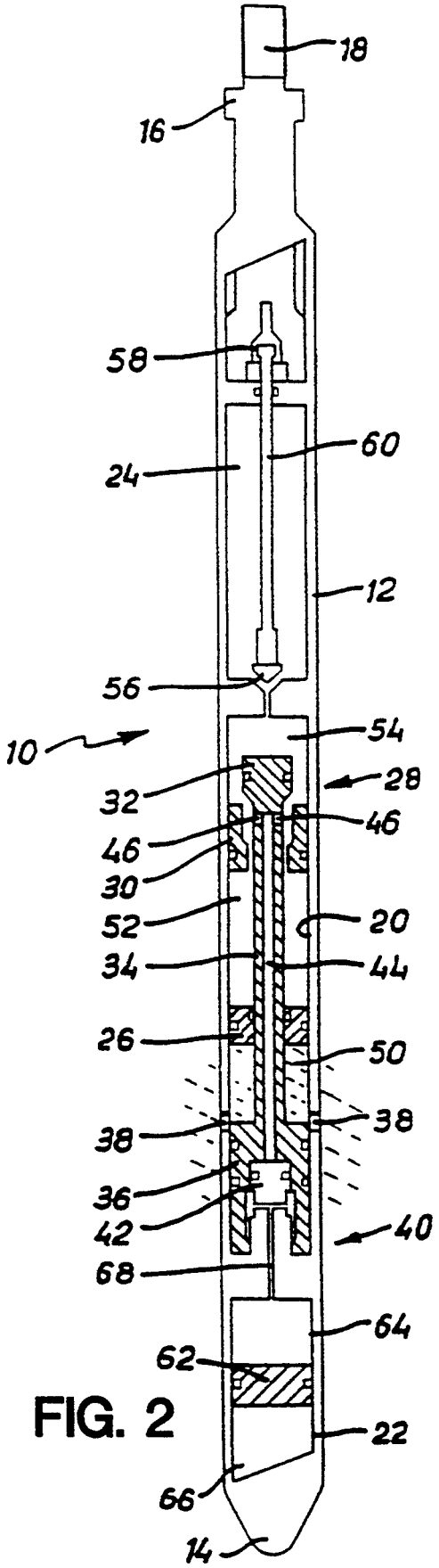

Referring now to FIG. 2, when the clock 58 causes or allows the regulator valve 56 to open, this permits the hydraulic oil in the dashpot chamber 54 to escape into the air chamber 24 at a controlled rate determined by the dimensions of a flow-restricting orifice comprised in the regulator valve 56. The pressure which drives the hydraulic oil through the regulator valve 56 into the air chamber 24 derives from the relatively very high pressure (e.g. 10,000 psi or 680 bar) of surrounding well fluid passing in through the well fluid inlet ports 38, driving up the first floating piston 26 and so transferring hydraulic oil (at well fluid pressure) from the pressurisation chamber 52, through the still-open limit valve assembly 28 into the dashpot chamber 54, and thence through the regulator valve 56 into the air chamber 24 with its relatively low back pressure (initially about 14 psi or 1 bar). (The regulator valve 56 does not re-close during this sequence of well-fluid-sampling steps).

As the first floating piston 26 is driven up the first cylinder 20 by the inflow of ambient well fluid through the inlet ports 38, the sample chamber 50 increases the internal volume to accommodate the intake of well fluid, and the volume of the pressurisation chamber 52 correspondingly decreases. After a certain intake of well fluid into the sample chamber 50, the first floating piston 26 will come into contact with the annular limit valve member 30. The continuing intake of well fluid through the still-open inlet ports 38 causes further upward movement of the first floating piston 26 and thereby moves the annular valve member 30 into sealing contact around the plug valve member 32, so closing the limit valve assembly 28 and hydraulically isolating the now-zero-volume pressurisation chamber 52 from the still-non-zero-volume dashpot chamber 54. The latter configuration of the sampling tool 10 is depicted in FIG. 3.

Figure 4:
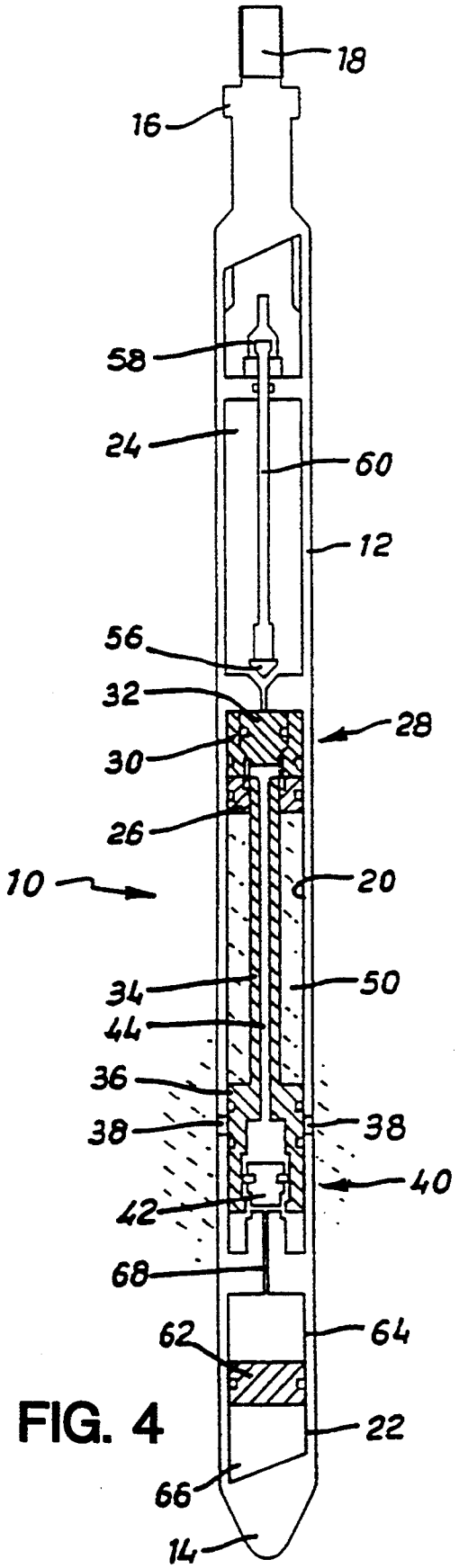

With the limit valve assembly 28 now closed, the hydraulic oil remaining in the dashpot chamber 54 is driven out through the regulator valve 56 by further upward movement of the piston 26 in contact with the limit valve assembly 28, simultaneously lifting the inlet control valve member 36 by means of the pull-rod 34 and thereby shortly closing the inlet ports 38 against further ingress of well fluid to the sample chamber 50. The latter configuration is depicted in FIG. 4.

Closure of the inlet ports 38 by lifting of the inlet control valve member 36 simultaneously opens the pressurisation control valve 40 since the member 36 doubles as armature therefor. Thereby the hydraulic oil in the pressure transmitting chamber 64 comes into hydraulic communication with remnant hydraulic oil in the nominally zero-volume pressurisation chamber 52, such communication being by way of the conduit 68, the now-open valve 40, the pull-rod bore 44, and its lateral ports 46. consequently the gas pressure in the pressurisation reservoir 66 transmits through the second floating piston 62 into the hydraulic oil above this piston and thence by the above-mentioned hydraulic pressure communication path to the pressurisation chamber 52 and the topside of the first floating piston 26. Thus the compressed gas in the reservoir 66 pressurises the sampled well fluid now sealed within the sample chamber 50 by the lifting of the inlet control valve member 36 to cover and seal the well fluid inlet ports 38. The inlet control valve member 36 is held in its port-closing upward position against the downward force arising from the pressurisation of the well fluid sample in the sample chamber 50 (of which the member 36 defines the lower end face) by the above-described opening of the pressurisation control valve 40 serving simultaneously to feed pressurised hydraulic oil to the lower end face of the valve member 36 and thus exert a balancing upward force stabilising the valve member 36 in its upward position, as depicted in FIGS. 4 and 5.

The tool 10, enclosing the sample of well fluid in its chamber 50, is then lifted to the surface where the sample is decanted into a sample transfer container as will be described below with reference to FIGS. 7–11. During the ascent of the sampling tool 10, there will be a natural tendency for the tool and its contents to cool down from the relatively elevated temperatures typically found at the substantial depths where well fluids are normally sampled. Consequently, the well fluid sample held in the sample chamber 50 can be expected to undergo thermal shrinkage. The typical prior art BHS tool having a sample chamber with a substantially invariable internal volume will therefore induce a drop in sample pressure leading to phase separation with the undesirable consequences previously described.

By way of complete contrast with the prior art, the tool 10 of the present invention has a sample chamber 50 of variable internal volume (by reason of the piston 26) and further includes sample pressurisation means (detailed above) for pressurising well fluid sealed into the sample chamber in a manner and to an extent tending to maintain initial (well bottom) pressure conditions in the sample despite cooling, and in particular by maintaining the sampled well fluid in its original single-phase form.

Figure 5:
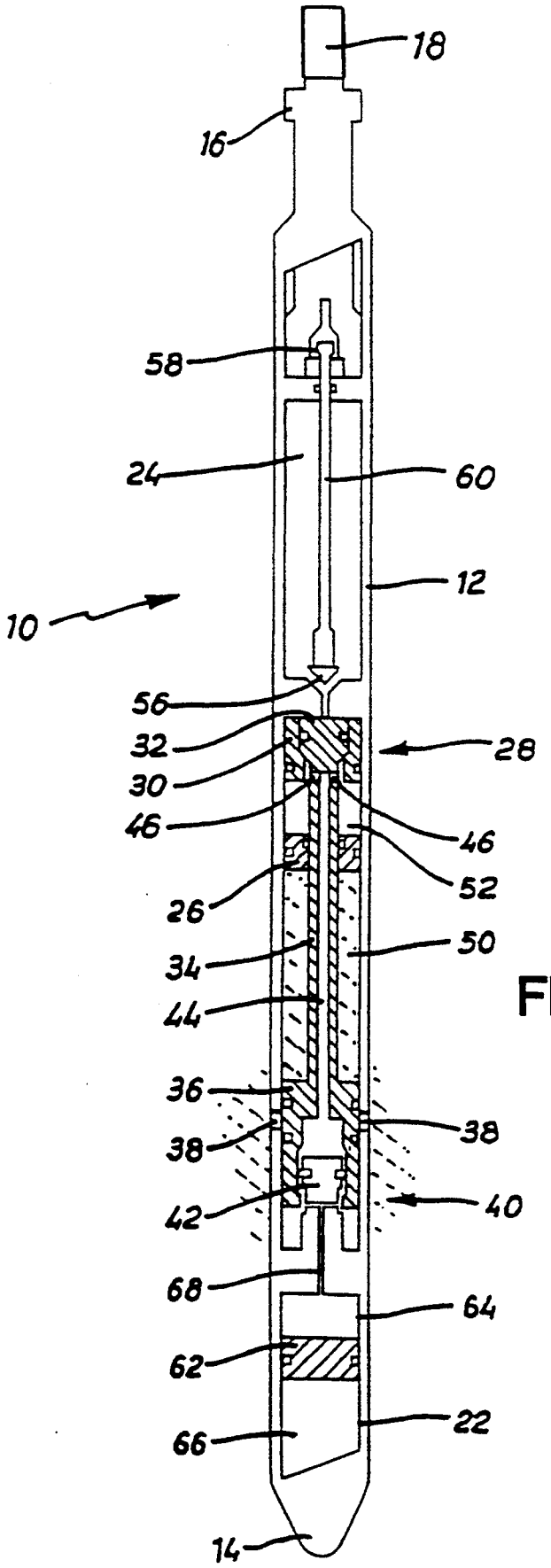

The pressurisation of the sample chamber 50 to maintain the enclosed well fluid sample in its original single-phase form, despite cooling and thermal shrinkage, is depicted in FIG. 5 wherein the reduction in internal volume of the sample chamber 50 results in a corresponding increase in the internal volume of the pressurisation chamber 52 under the hydraulically-transmitted sustained pressure of gas in the reservoir 66.

A particular advantage in the exemplary form of well fluid sampling tool 10 described above with reference to FIGS. 1–5 arises from the use of hydraulic oil to transmit the gas pressure from the reservoir 66 to the sampled well fluid in the sample chamber 50. In any practicable arrangement, there will be an almost inevitable leakage of pressurising gas past the sliding seals required for transmission of pressure from gas to liquid or to essentially liquid single-phase fluid. Were the pressurising gas to be separated from the sampled well fluid only by an intervening floating piston, pressurising gas would seep past the piston/bore seal and corrupt the analytical results subsequently to be obtained from the sample. By contrast, in the arrangement shown in FIGS. 1–5 such seepage would reach only the hydraulic oil employed for pressure transmission where its presence would be relatively unimportant. Further progression of the seeped gas through the hydraulic oil as far as the sampled fluid would be improbable or very slow.

Figure 6:
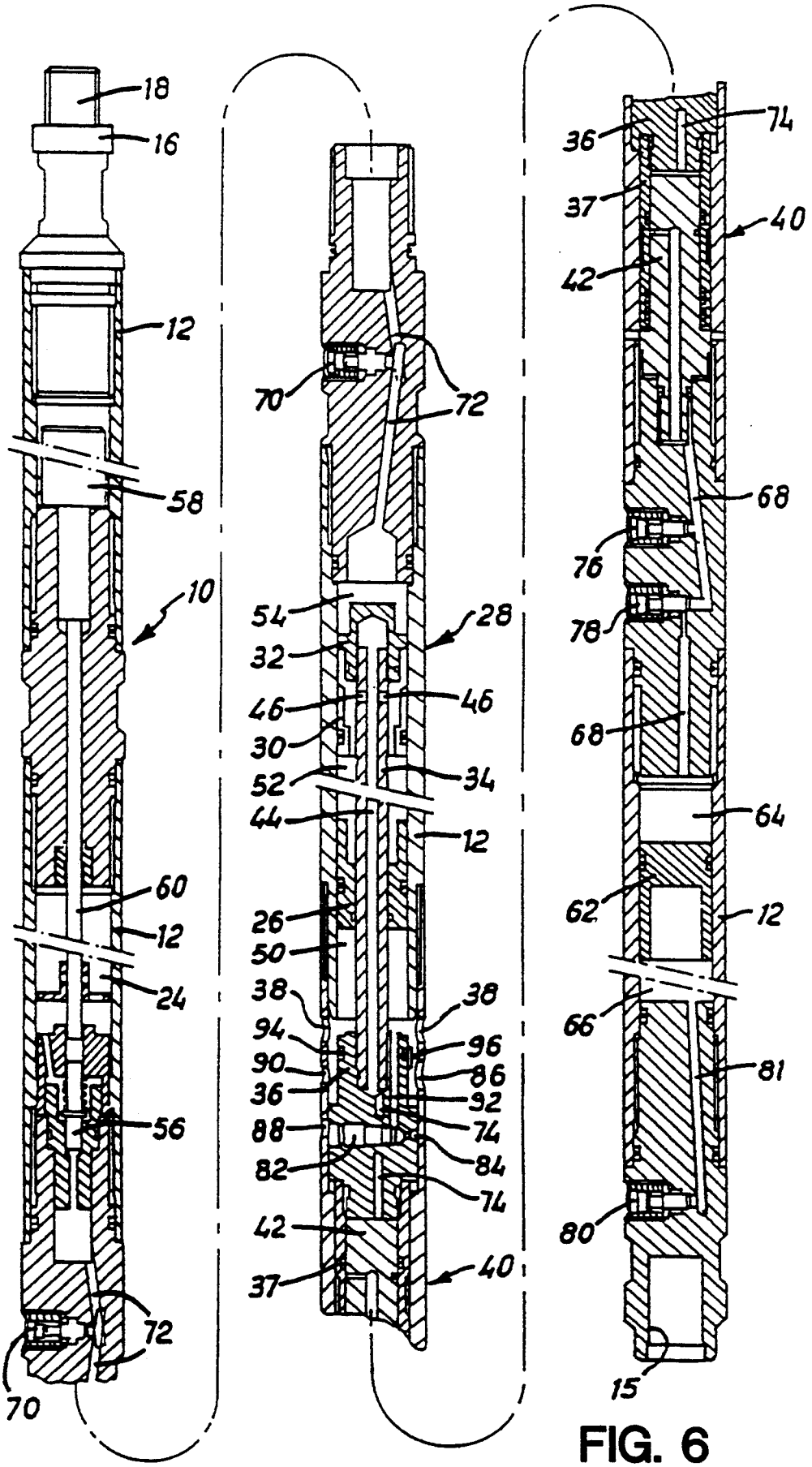
FIG. 6 is a longitudinal section of the first embodiment, illustrating structural details thereof.

Referring now to FIG. 6, this is an engineering drawing of the well fluid sampling tool 10 schematically illustrated in FIGS. 1–5. Owing to the very high length-to-diameter ratio of the tool 10, FIG. 6 is split into three sections laid side-by-side and related by the chain-dash centre line, with short lengths of duplicated components at each section break.

The components of the tool 10 as depicted in FIG. 6 and which have the same structural and functional relationship to the tool components as depicted in FIGS. 1–5 are given the same reference numerals as were used in FIGS. 1–5. However, as shown in FIG. 6, the tool components do not have positional relationships corresponding exactly to any one of FIGS. 1–5. In view of the overall similarity of the tool 10 as depicted in FIG. 6 to the same tool as schematically depicted in FIGS. 1–5, the following description of FIG. 6 will concentrate on those details differing significantly from the preceding figures.

The inlet valve control member 36 is not unitary with the armature of the pressurisation control valve 40, but has a sleeve 37 attached thereto to serve as the movable component of the shuttle valve 40.

The bull nose 14 shown in FIGS. 1–5 is omitted in FIG. 6, and is replaced by an internally screw-threaded box connector 15.

The valve-controlled priming ports previously referred to but not shown in FIGS. 1–5 are shown in FIG. 6, as follows:

An isolating valve 70 set into the tool casing 12 allows admission of hydraulic oil to the dashpot chamber 54 through drilled passages 72 linking the chamber 54 to the regulating valve 56. Since the limit valve 28 is initially open, and since the lateral ports 46 in the pull-rod 34 are permanently open, hydraulic oil admitted through the isolating valve 70 also fills the pressurisation chamber 52 and the pull-rod bore 44 down to the pressurisation valve spool 42, this oil reaching the latter through an axially offset longitudinal passage 74 through the inlet control valve member 36.

A further isolating valve 76 set into the tool casing 12 allows admission of hydraulic oil to the conduit 68 and to the pressure transmitting chamber 64. Another isolating valve 78 enables the conduit 68 to be selectively closed to inhibit premature pressurisation prior to use of the tool 10.

An additional isolating valve 80 controls admission of pressurising gas to the pressurisation reservoir 66 via an internal passage 81.

A sample isolating valve 82 is set into the inlet control valve member 36 for Controlled discharge of sampled well fluid from the sample chamber 50 after retrieval of the sampling tool 10 from the well to the surface. The sample isolating valve 82 has a lateral outlet port 84 accessed through a casing aperture 86 when the inlet control valve member 36 is lifted to its closed position (as shown in FIGS. 4 and 5). Lateral access through the tool casing 12 for operation of the sample isolating valve 82 is enabled by a casing aperture 88 when the inlet control valve member 36 is in its lower (open) position, and by a casing aperture 90 when the inlet control valve member 36 is in its upper (closed) position. Sampled well fluid is discharged from the sample chamber 50 via an axially-offset longitudinal passage 92 formed in the inlet control valve member 36, the closure member of the sample isolating valve 82, the later outlet port 84, and the casing aperture 86.

Sealing of the inlet control valve member 36 to the tool casing 12 immediately above the inlet .ports 38 (when closed by the raising of the member 36) is achieved by a circumferentially-disposed external O-ring seal 94, which is held in place prior to inlet control valve closure by an axially slidable retainer ring 96. During raising of the inlet control valve member 36 to close the inlet ports 38, the retainer ring 96 is pushed down the rising valve member 36 by contact with the lower end of the chamber 50, so allowing the seal 94 to come into sealing contact with the bore of the sample chamber 50 and thus close off the sample chamber 50 to seal the well fluid sample therein.

Figure 7:
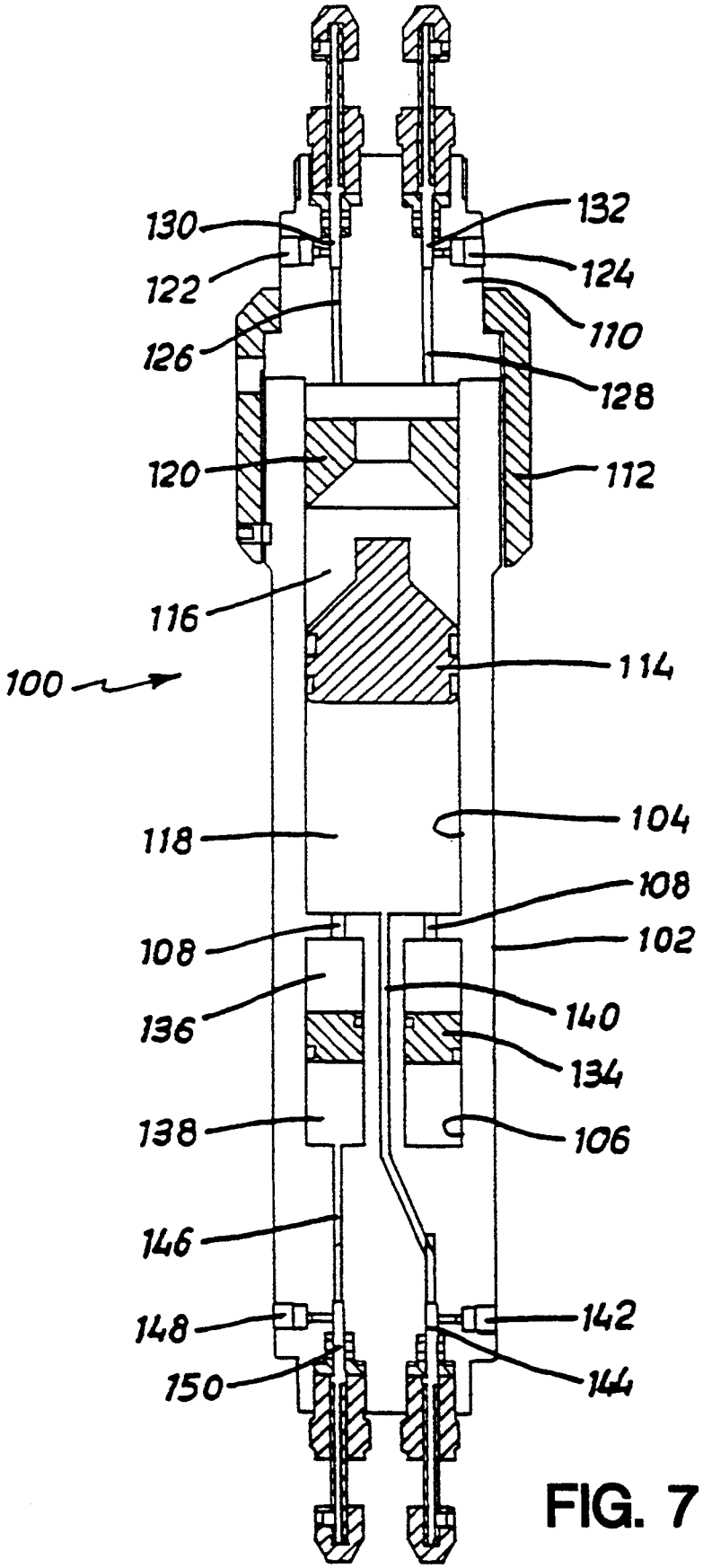
FIG. 7 is a longitudinal section of a first embodiment of sampled well fluid transfer container in accordance with the invention.

Referring now to FIG. 7, this illustrates a longitudinal section of a first embodiment 100 of well fluid sample transfer container in accordance with the fourth aspect of the present invention. The container 100 is intended to be used in conjunction with the well fluid sampling tool 10 previously described with reference to FIGS. 1–5, as will subsequently be described with reference to FIGS. 8–11.

The transfer container 100 comprises a generally cylindrical casing 102 internally divided into first and second cylinders 104 and 106, permanently mutually connected by internal passages 108. The top end of the casing 102 is closed by an end cap 110 retained on the casing 102 by a screw-threaded retainer ring 112.

The first cylinder 104 is internally divided by a first floating piston 114 into a sample chamber 116 and a pressurisation chamber 118. The piston 114 is slidingly sealed to the bore of the cylinder 104 in order to physically separate respective fluids in the chambers 104 and 106 while substantially egualising pressure therebetween and allowing each of these chambers 104 and 106 to have a variable internal volume. An annular agitator ring 120 is loosely located in the sample chamber 116 for a purpose to be detailed below.

A pair of sampled well fluid inlet/outlet ports 122 and 124 in the end cap 110 each communicate with the sample chamber 116 by way of a respective passage 126 and 128 which can each be selectively opened or closed by a manually operable isolating valve 130 and 132 respectively.

The second cylinder 106 is similarly internally divided by a second floating piston 134 into a pressure transmitting chamber 136 and a pressurisation reservoir 138. The pressure transmitting chamber 136 is permanently hydraulically connected to the pressurisation chamber 118 by means of the internal passages 108.

A fixed central hydraulic conduit 140 passes axially through the second cylinder 106 to communicate the pressurisation chamber. 118 with an external port 142 in the lower end of the casing 102. The hydraulic conduit 140 can be selectively opened or closed by a manually operable isolating valve 144.

The external surface of the conduit 140 is cylindrical and coaxial with the bore of the second cylinder 106. The second floating piston 134 is annular and is slidingly sealed both to the bore of the second cylinder i06 and to the external surface of the through-cylinder conduit 140 in order physically to separate respective fluids in the chambers 136 and 138 while substantially egualising pressures therebetween and allowing the chambers 136 and 138 to have variable internal volumes.

A further passage 146 in the lower end of the casing 102 communicates the pressurisation reservoir 138 with a further external port 148 in the lower end of the casing 102. The passage 146 can be selectively opened or closed by a further manually operable isolating valve 150.

Use of the well fluid sample transfer container 100 in conjunction with the well fluid sample tool 10 will now be described with reference to FIGS. 8–11 wherein only the lower sample-holding half of the tool 10 is schematically depicted.

Prior to sample-transferring use of the container 100, the pressure transmitting and pressurisation chambers 136 and 118 are primed by being filled through the external port 142 and the temporarily open isolating valve 144 with a suitable incompressible hydraulic fluid, preferably a mixture of water and ethylene glycol. This hydraulic priming of the chambers 136 and 118 is carried out with the isolating valve 150 and one or both of the isolating valves 130 and 132 temporarily open to allow the chambers 136 and 118 both to expand to their maximum internal volume, with concomitant reduction to zero internal volume of both the sample chamber 116 and the pressurisation reservoir 138. The agitator ring 120 nests around the top of the first floating piston 114 in order substantially to eliminate dead volume in the sample chamber 116, as depicted in FIG. 8.

Figure 8:
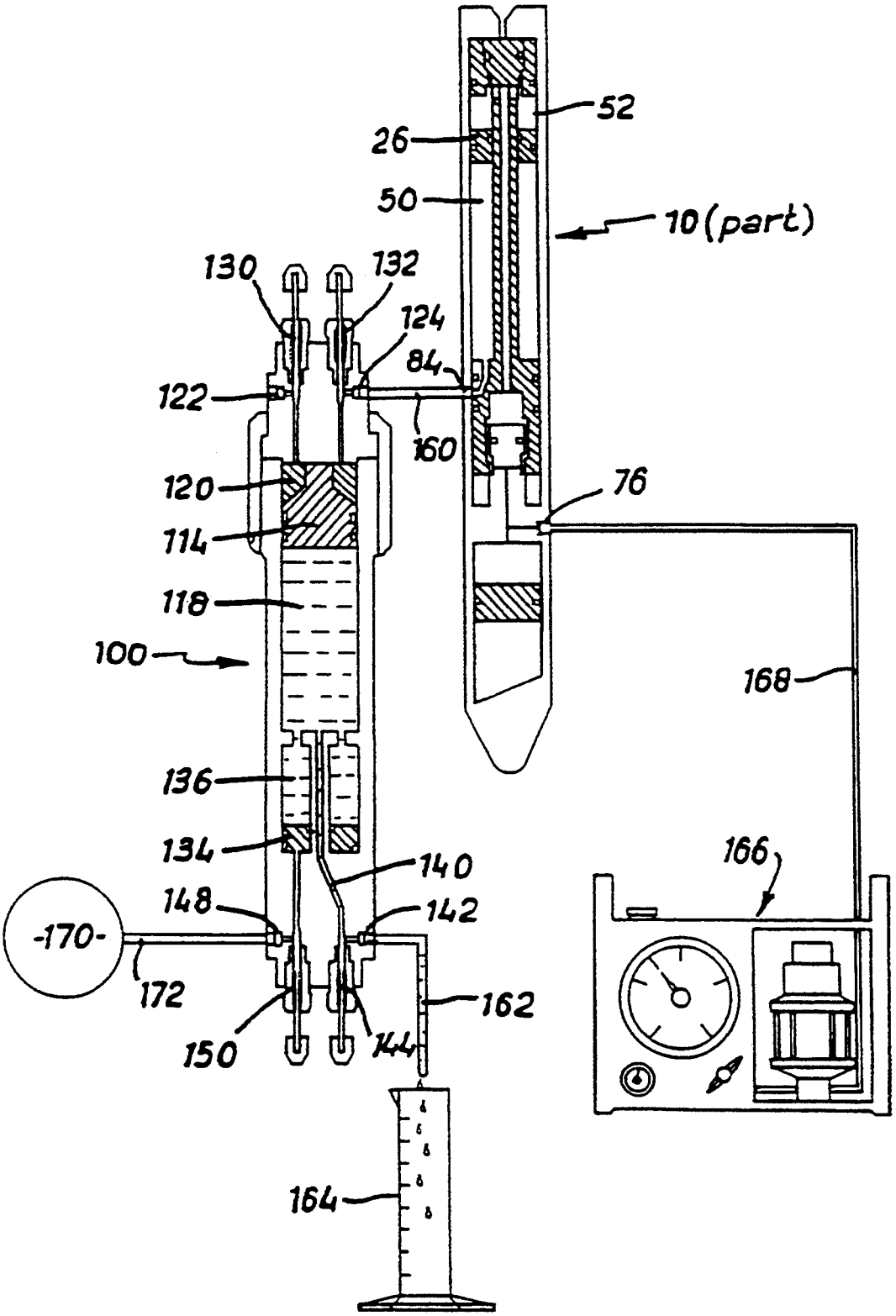
FIGS. 8–11 illustrate the transfer container of FIG. 7 in various successive stages of its utilisation.
Figure 9:
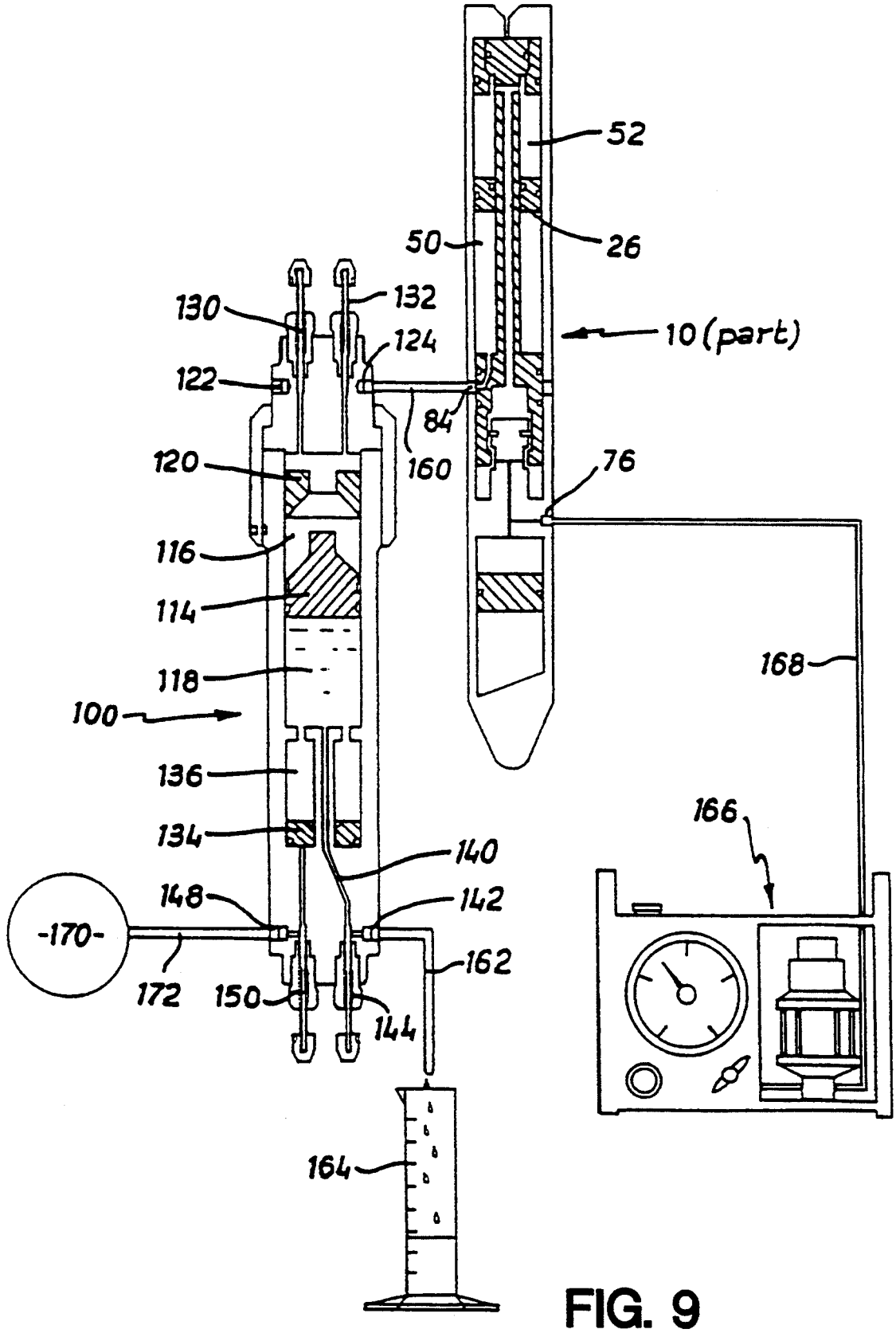
Figure 10:
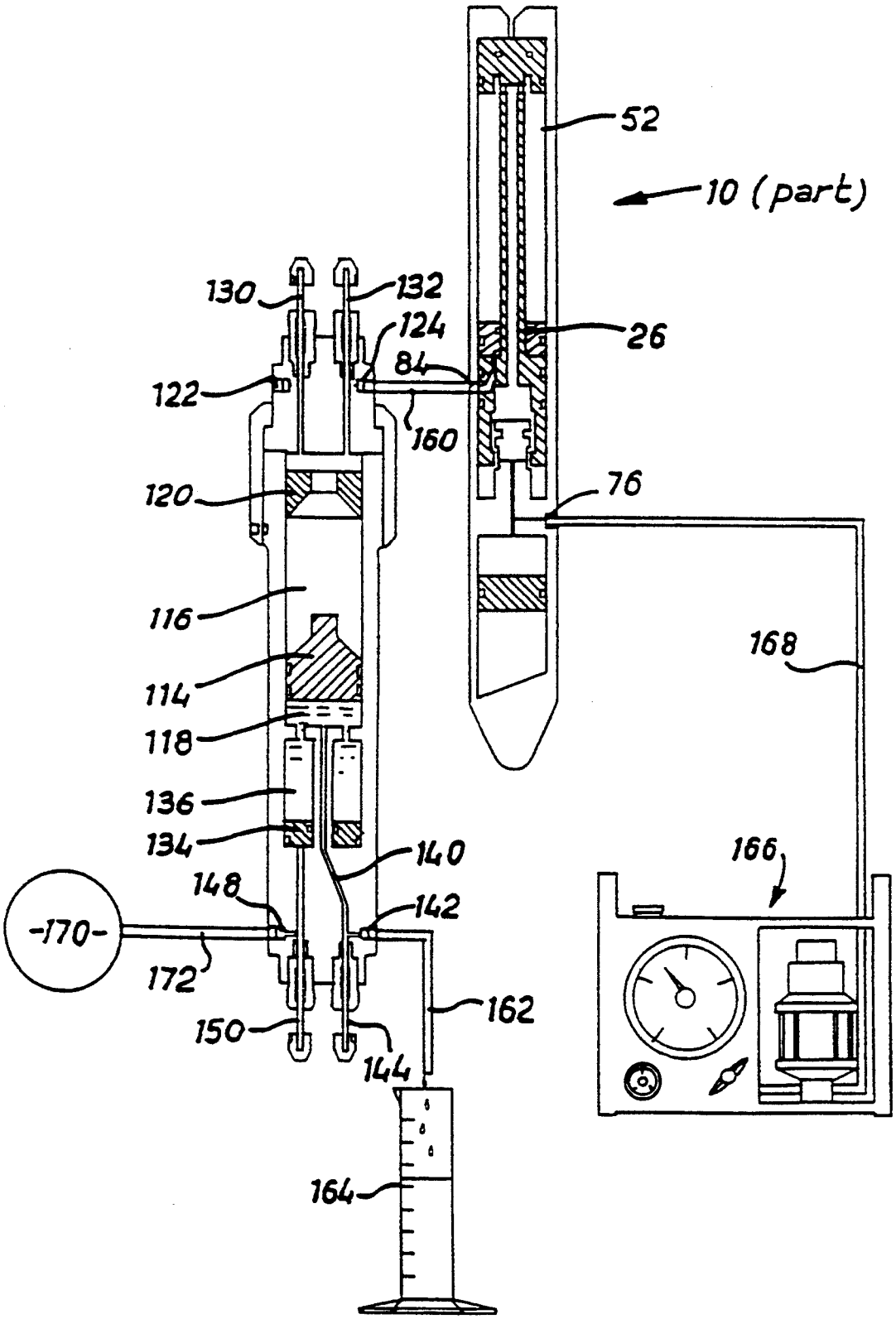

FIG. 8 depicts the first stage of sample transfer following the above-described priming of the transfer container 100. All isolating valves are initially shut (except that the open/close state state of the pressurisation reservoir isolating valve 150 is immaterial at this stage). The sample port 124 (see FIG. 7) is coupled to the sample transfer port 84 in the tool 10 (see FIG. 6) by a high pressure hose 160 (or any other suitable conduit), the sample isolating valve 82 in the tool 10 being initially closed. A run-off pipe 162 is coupled to the external port 142, and discharges into a measuring jar 164 (or any other suitable graduated liquid receiver). A controllable output high pressure oil pump 166 is coupled via a high pressure hose 168 (or any other suitable conduit) to the isolating valve 76 in the tool 10, and thence to the pressurisation chamber 52. The tool isolating valves 70, 82, 78, and 80 are initially closed. An external source 170 of highly compressed gaseous nitrogen (or any other suitable elastic pressurisation source), is connected to the container port 148 via a high pressure hose 172 (or any other suitable conduit). To commence transfer of the sampled well fluid from the tool 10 to the container 100, the pump 166 is made ready, and the valves 76, 82, 132, and 144 are opened (either simultaneously or in appropriate sequence)The pump 166 is controlled to force hydraulic oil into the tool pressurisation chamber 52 and so drive the first floating piston 26 downwards in the tool 10 to diminish the internal volume of the sample chamber 50, thus forcing sample fluid under pressure into the sample chamber 116 in the transfer container 100, as depicted in FIG. 9. By merely cracking open the isolating valve 144, the outflow of hydraulic fluid (water/ethylene glycol) from the pressurisation chamber 118 in the transfer container 100 can readily be manually throttled to sustain the sampled well fluid at a high pressure which retains the sample in its original single-phase form, due to the backpressure in the pressurisation chamber 118 being thereby maintained nearly equal to the pump-induced forward pressure in the pressurisation chamber 52.

Hydraulic fluid forced out of the pressurisation chamber 118 is collected in the measuring jar 164 to give a measure of the instantaneous volume of sampled well fluid that has been forced from the tool 10 into the transfer container 100, such a measure being readily obtained by visually inspecting the level of collected hydraulic fluid in the jar 164 against the volumetric graduations thereon.

When observation of the measuring jar 164 indicates that an appropriate volume of sampled well fluid has been transferred from the tool 10 into the transfer container 100 (FIG. 10), the isolating valve 132 is closed, and the pump 166 is shut down.

Figure 11:
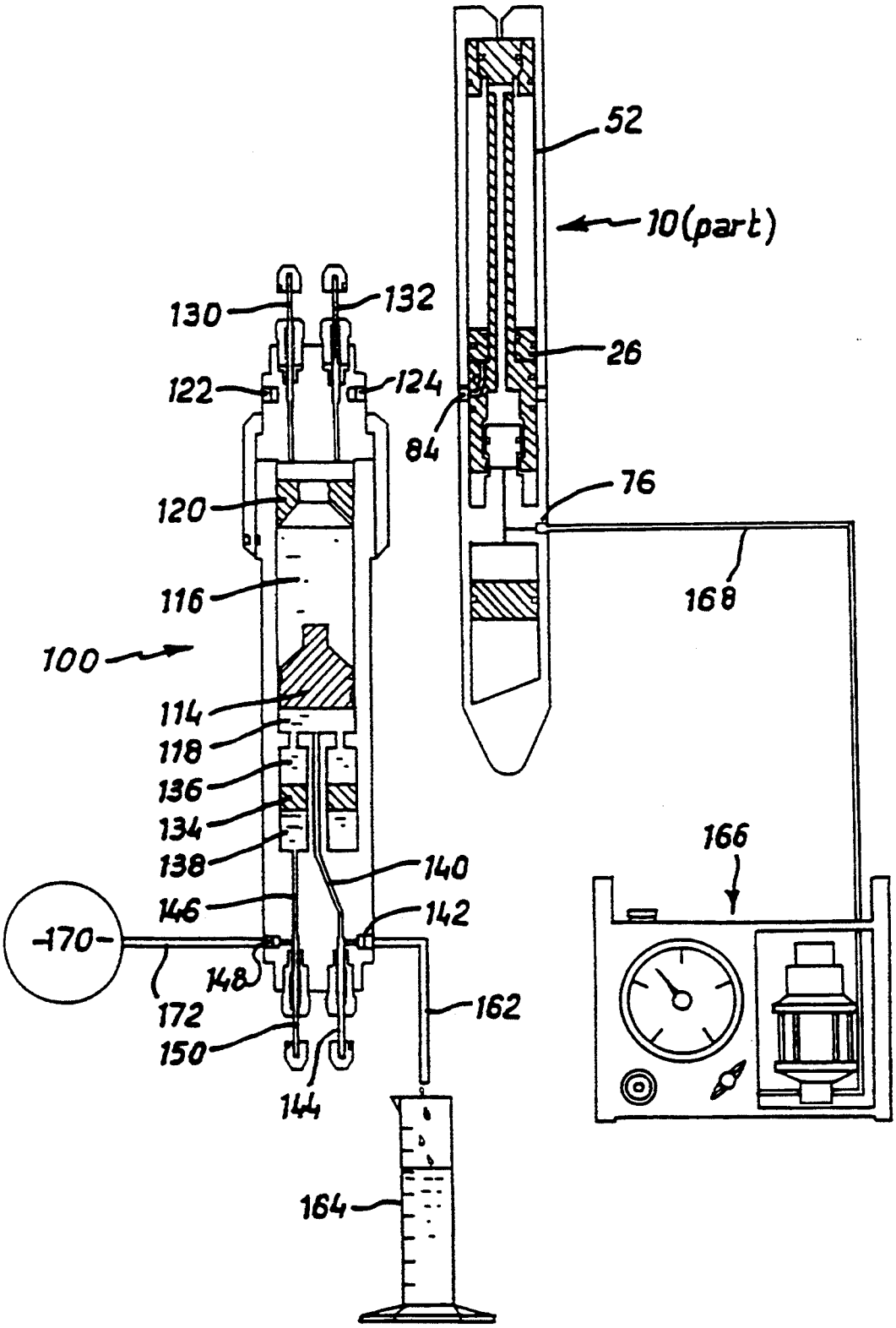

Next, the source of highly compressed gaseous nitrogen (not shown) coupled to the container port 148 is admitted to the pressurisation reservoir 138 by cracking open the manually operated isolating valve 150, thus driving the second floating piston 134 upwards within the second transfer container cylinder 106 (FIG. 11). Because the internal volume of the sample chamber 116 is currently held fixed by the closure of the isolating valves 130 and 132, the charging of the pressurisation reservoir 138 with highly compressed nitrogen gas results in a reduction of the internal volume of the pressure transmitting chamber 136 and a consequent further discharge of hydraulic fluid into the measuring jar 164. When the current increment of hydraulic fluid collected in the jar 164 is measured as indicating that the pressurisation reservoir 138 is adequately charged with sample-pressurising gas, the isolating valve 150 is re-closed to seal the pressurisation reservoir 138.

The transfer container 100 now contains a determined volume of sampled well fluid, and sufficient high pressure nitrogen to maintain the sample in its original downwell single-phase form. The currently sealed container 100 is detached from the tool 10, the measuring jar 164, and the nitrogen source by disconnection of the hoses 160, 162, and 170. The sealed and isolated transfer container 100 is now ready for transport of the fully pressurised well fluid sample to a remote analytical laboratory where the sample can be analysed in its original single-phase form. This procedure avoids the undesirable phase separation and pre-analytical phase recombination necessary in the prior art.

When the sample has been retrieved from the transfer container 100 at the analytical laboratory, the sample chamber 116 can be flushed clean by attaching one of the ports 122 and 124 to a source of flushing fluid (not shown), attaching a suitable exhaust line to the other of these ports, and opening both valves 130 and 132 to flow the flushing fluid into, through and out of the sample chamber 116. As part of this flushing process, the piston 114 is preferably driven to the top of the cylinder 104 such that with the agitator ring 120 nested around the top of the piston 114 (compare with FIG. 8), the internal volume of the sample chamber 116 is reduced to its minimum (nominal zero). Such flushing obviates the risk of well fluid carry-over between samples, which would undesirably corrupt analytical values.

Figure 12:
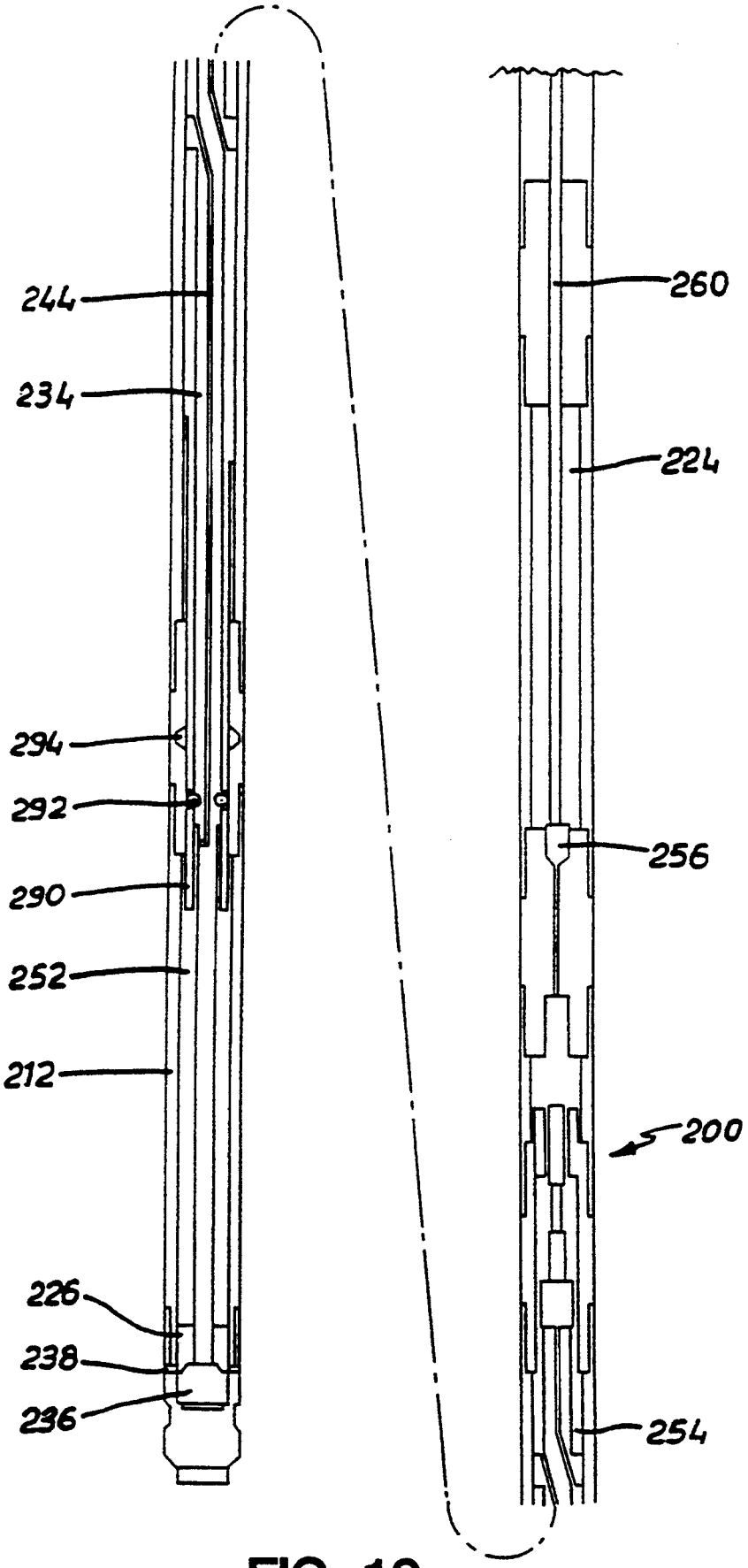
FIGS. 12–14 illustrate a second embodiment of well fluid sampling tool in accordance with the invention, in various successive stages of its utilisation.
Figure 13:
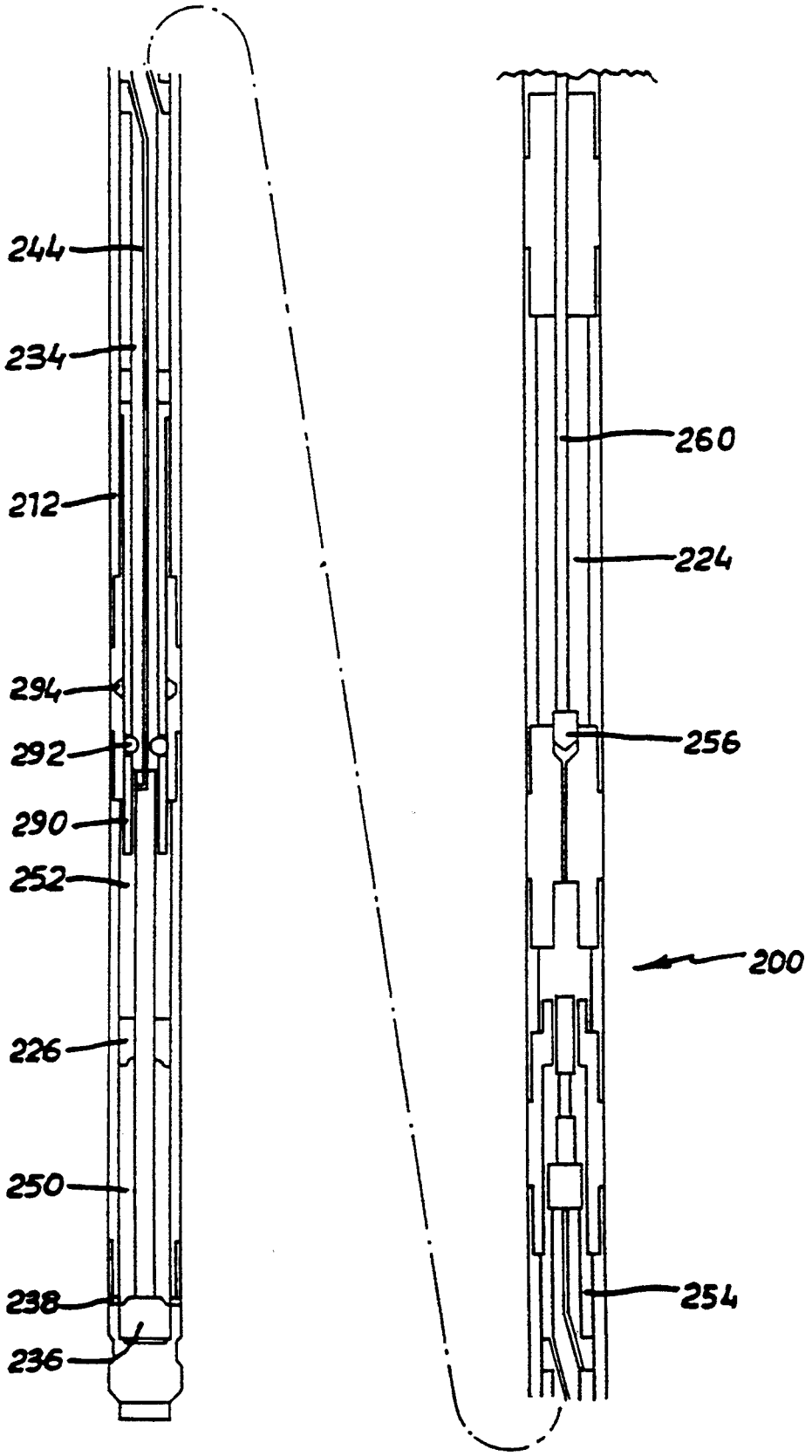
Figure 14:
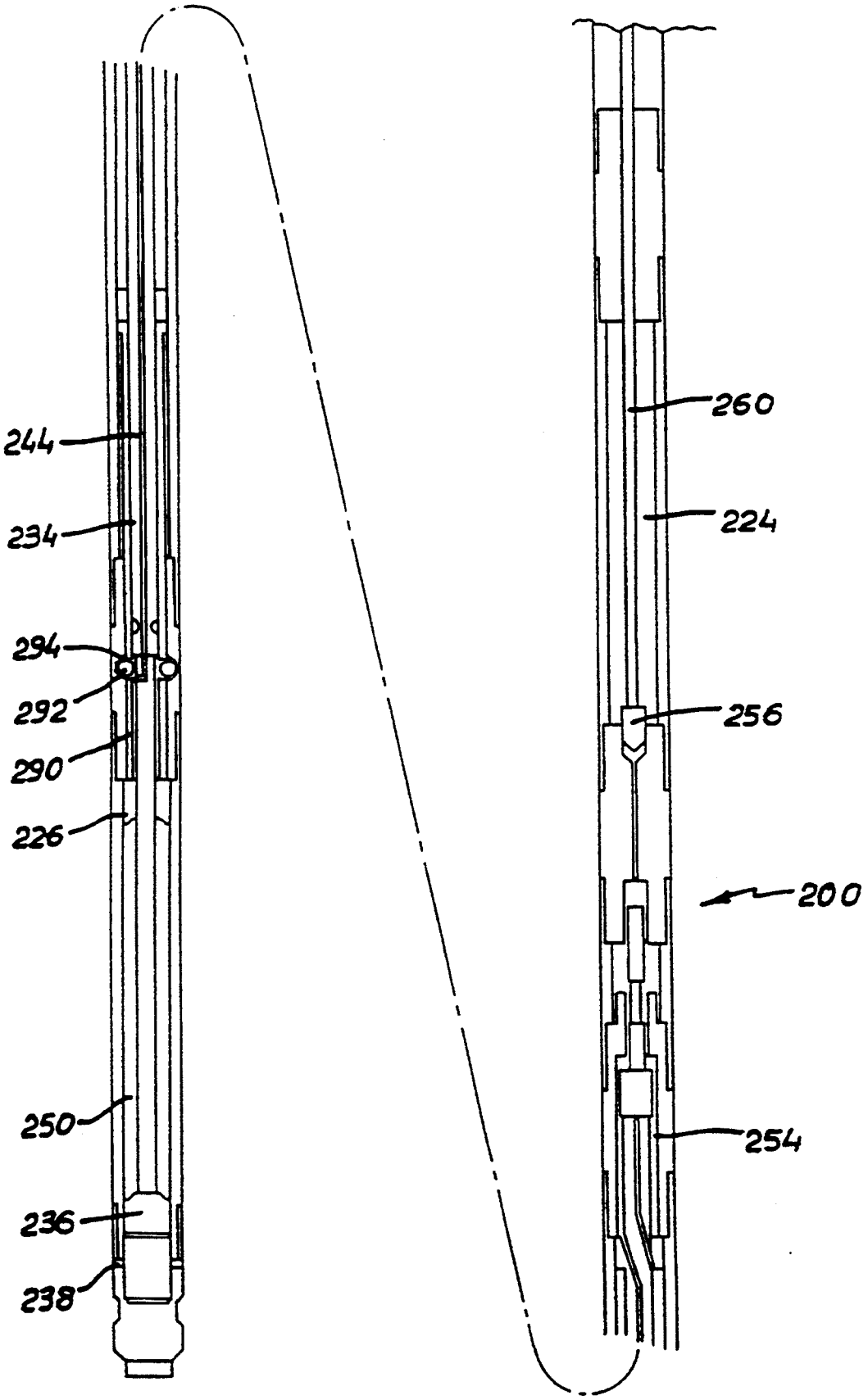

Referring now to FIGS. 12, 13, and 14), these show a second embodiment 200 of well fluid sampling tool in accordance with the invention, in three successive stages of its well fluid sampling operation. Parts of the second embodiment 200 which correspond to the first embodiment 10 are given the same reference numeral prefixed by "2" (i.e. the references of FIGS. 12–14 are the references of FIGS. 1–6 plus 200).

The tool 200 differs from the tool 10 in that at the upper end of the pressurisation chamber 252 is a sleeve 290 initially mechanically linked to the pull-rod 234 by a pair of latching balls 292 held in notches in the pull-rod 234 by a circumferentially narrow portion of the casing 212 (FIG. 12).

When the clock (not shown in FIG. 12– 14) lifts the pull-rod 260 to open the regulator valve 256, the dash-pot chamber 254 and the hydraulically linked pressurisation chamber 252 are allowed to vent at an orifice-controlled rate into the air chamber 224 (FIG. 13). This allows the floating piston 226 to rise and admit well fluid through the inlet ports 238 into the now-expanding sample chamber 250.

When the sample chamber 250 reaches its maximum internal volume, the floating piston 226 moves the sleeve 290 upwards within the casing 212 until the latching balls 292 drop radially outwards from the pull-rod notches into an annular recess 294 in the casing 212 (FIG. 14). This frees the pull-rod 234 from the sleeve 290 to allow nitrogen-induced pressurisation of the piston 226 to maintain the sampled well fluid in the chamber 250 at a pressure which keeps the sample in its original single-phase form.

Figure 15:
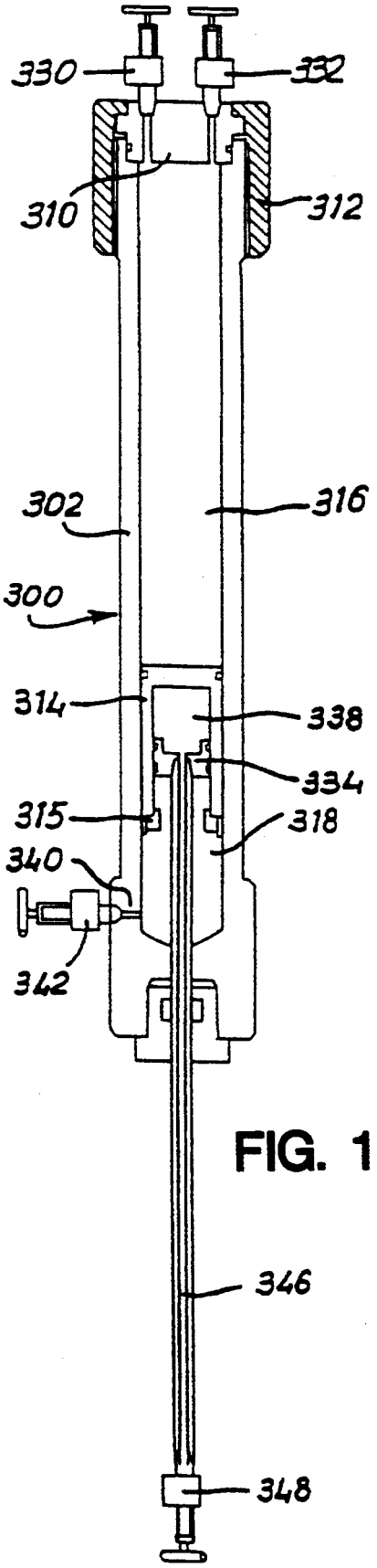
FIG. 15 is a longitudinal section of a second embodiment of sampled well fluid transfer container in accordance with the invention.

Referring now to FIG. 15, this illustrates a longitudinal cross-section of a second embodiment 300 of well fluid transfer container in accordance with the invention. Parts of the second container embodiment 300 which correspond to structurally and/or functionally equivalent parts of the first container embodiment 100 are given the same reference numerals, but preceded by a "3" instead of a "1" (ie references of FIG. 7, plus 200).

The transfer container 300 (FIG. 15) differs from the transfer container 100 (FIG. 7) in that the second floating piston 334 is now nested within the first floating piston 314, which is hollow to accommodate the nested piston 334. An internal skirt ring 315 on the lower end of the piston 314 prevents the piston 334 being de-nested from the piston 314 by excess relative movement. The variable-volume chamber 338 between the nested pistons 314 and 334 is equivalent to the chamber 138. The variable volume chamber 318, below the nested piston 334, is a combined equivalent of the pressurisation chamber 118 and the pressure transmitting chamber 136. The conduit 346 is mechanically linked to the second floating piston 334, and consequently the conduit 346 is slidingly sealed into the bottom end of the container casing 302 to accommodate movement of the piston 334.

The transfer container 300 is otherwise functionally equivalent to the transfer container 100, and may be substituted therefor in the well-fluid sample transfer procedure described above with reference to FIGS. 8–11.

Referring now to FIGS. 16–18, these are sectional elevations of a modified form of the regulator valve 56 and the clock 58 (schematically depicted in FIGS. 1–5, 28 and shown in greater detail in FIG. 6). FIG. 16 is a sectional elevation of the modified regulator valve 56A and its actuating/release mechanism up to the point of attachment of the pull-rod 60A to the clock mechanism (FIG. 18). FIG. 16 corresponds to the lower two-thirds of the leftmost of the three tool sections illustrated in FIG. 6. FIG. 17 shows the lower half of FIG. 16 to an enlarged scale for greater clarity of detail. FIG. 18 is a sectional elevation of the modified clock mechanism 58A, which in practice attaches (as detailed below) to the top of the arrangement shown in FIG. 16, then to be equivalent to the arrangement shown in the leftmost section of FIG. 6. Those parts of the arrangement of FIGS. 16–18 which are identical to, or substantially correspond to, parts of the FIG. 6 arrangement are given the same reference numerals as are employed in FIG. 6, and to the description of which reference should be made for details of the FIGS. 16–18 arrangement not specifically described below.

The modified regulator valve 56A comprises a longitudinally slidable needle 400 cooperating with a fixed orifice member 402 (not clearly seen in FIG. 17). A labyrinthine hydraulic flow restrictor 404 is disposed between the passage 72 and the orifice member 402. The needle 400 is initially held down against the orifice member 402 by a coiled compression spring 406 reacting against a longitudinally slidable sleeve 408 which is initially latched in the position shown in FIGS. 16 and 17. In this pre-sampling primed configuration (equivalent to the FIG. 1 configuration) the needle 400 is spring biassed against the orifice member 402 to hold the modified regulator valve 56A normally closed. However the spring 406 allows the valve 56A to crack open under the influence of excessive hydraulic pressure of the oil in the passage 72, due for example to thermal expansion of the oil as the primed sampling tool is lowered downwell, and the modified regulator valve 56A thus additionally functions as an over-pressure relief valve. The sleeve 408 is initially latched in the illustrated position by means of a pair of stell balls 410 radially movable in the sleeve 408 and held outwards to latch on a casing shoulder 412 by means of the lower end of the pull-rod 60A extending between the balls 410. When the pull-road 60A is lifted by means of the clock mechanism 58A (as detailed below), the balls 410 move radially inwards of the sleeve 408 and out of engagement with the casing shoulder 412. This unlatching operation allows the sleeve 408 to be moved upwards by the spring 406 and so relieve the downforce on the needle 400. This opens the regulator valve 56A to allow hydraulic oil in the passage 72 to flow through the restrictor 404 and into the air chamber 24 as previously described with reference to FIG. 2.

Turning now to the modified clock mechanism 58A shown in FIG. 18, this comprises a fixed hollow cylindrical clock casing 450 closed at its lower end by a fixed bush 452. A tube 454 is mounted within the casing 450 to be longitudinally slidable through the bush 452. The upper end of the tube 454 is attached to a sleeve 456 which is longitudinally slidable but non-rotatable within the clock casing 450. A coiled compression spring 458 is located around the tube 454 and reacts against the fixed bush 452 to bias the sleeve 456, together with the attached tube 454, upwards within the clock casing 450.

A collar 460 is rotatably mounted inside the upper end of the clock casing 450, but is axially immovable. The collar 460 supports a ball-screw worm 462 to depend inside the sleeve 456, the worm 462 being rigidly attached to the rotatable collar 460 such that the worm 462 can rotate but is prevented from undergoing any significant axial movement. The upper ends of the ball-carrying helical channels 464 of the ball-screw worm 462 lead into purely axial continuations 466, these axial continuations of the helical channels 464 being formed in the neck of the collar 460, for a purpose detailed below.

The upper end of the sleeve 456 is castellated to form purely axial ball-carrying spline channels 468 which are coupled to the worm channel continuations 466 by means of interposed bearing balls 470 (only one being shown in FIG. 18).

A chronometric rotary escapement mechanism 472 is secured on the upper end of the clock casing 450 and is linked to the ball-screw-supporting rotatable collar 460 through a uni-directionally free-wheeling clutch 474.

The pull-rod 60A is attached to the tube 454 near the top end thereof by means of a pin 476 extending radially through the mutually attached tube 454 and sleeve 456 to hook under a mushroom head 478 (FIG. 16) formed on the top of the pull-rod 60A. The pin 476 also projects radially outwards of the clock casing 450 through a longitudinally-extending graduated slot 477 in the casing 450, for a purpose detailed below.

To set the clock mechanism 58A for initiation of well-fluid-sampling operation of the tool 10 after a predetermined delay, the projecting pin 476 is pulled downwards along the slot 477 to come abreast of an appropriate graduation on the slot. The downward movement of the pin 476 pulls the sleeve 456 downwards within the clock casing 450 against the upward force of the spring 458 (this action being analogous to cocking a rifle bolt). The upper ends of the spline channels 458 in the sleeve 456 force the balls 470 down the axial continuations 466 and into the helical ball-carrying channels 464 in the ball-screw worm 462. Since the sleeve 456 is axially slidable but non-rotatable and the worm 462 is rotatable but axially immovable, the setting movement of the pin 476 forces the worm 462 to rotate. The free-wheeling direction of the clutch 474 is arranged so that this forced rotation of the worm 462 during setting of the timing mechanism does not force the escapement mechanism 472 to turn at the same time.

When the pin 476 has been pulled downwards by the requisite amount, it is released to allow the spring 458 to tend to return the sleeve 456 upwards to its initial position (as illustrated in FIG. 18). However, rapid upward movement of the sleeve 456 is prevented because the balls 470 currently linking the axially straight spline channels 468 with the helical worm channels 464 force the worm 462 to try to rotate, but such rotation is substantially retarded because the now-engaged clutch 474 causes return rotation of the worm 462 to drive the chronometric escapement mechanism 472 which permits only slow rotation. The eventual duration of such escapement rotation is selectively predetermined by the exent to which the pin 476 is pulled downwards. The energy for driving the escapement mechanism 472 derives from compression of the spring 458 during the setting procedure.

When the escapement mechanism 472 eventually permits the worm 462 to turn sufficiently far for the balls 470 to reach the upper ends of the helical worm channels 464, the balls 470 run into the purely axial continuations 466. Since the balls 470 are simultaneously running in the purely axial spline channels 468 in the sleeve 456, upward movement of the sleeve 456 no longer requires the worm 462 to rotate, and hence the escapement mechanism 472 abruptly ceases to affect retardation. The effective release of the sleeve 456 for upward movement under the continuing bias of the spring 458 results in relatively rapid upward movement of the pin 476, whose radially inner end catches under the pull-rod mushroom head 478 (FIG. 16) to lift the pull-rod 60A, release the balls 410 (FIG. 17) and open the regulator valve 56A to initiate well-fluid sampling by the tool 10 as previously detailed with reference to FIG. 2.

While certain modifications and variations have been described above, the invention is not restricted thereto, and other modifications and variations can be adopted without departing from the scope of the invention as defined in the appended claims.

We claim:

1. A well fluid sampling tool, said tool comprising a first cylinder, said first cylinder containing a first floating piston and a limit valve disposed at mutually different locations along the longitudinal axis of said first cylinder, said first floating piston being slidingly sealed to said first cylinder, said limit valve being movable by contact with said first floating piston between an open condition and a closed condition, said first floating piston and said limit valve dividing said first cylinder into a sample chamber having a variable internal volume, a dashpot chamber, and a pressurisation chamber intermediate said sample chamber and said dashpot chamber, adjacent ends of said sample chamber and said pressurisation chamber being defined by said first floating piston, adjacent ends of said pressurisation chamber and said dashpot chamber being defined by said limit valve, said first floating piston being bi-directionally movable along said first cylinder under the influence of the difference between fluid pressure in said sample chamber and fluid pressure in said pressurisation chamber, said sample chamber having a well fluid inlet port at an end of said sample chamber remote from said pressurisation chamber for admission of a sample of well fluid to said sample chamber, a well fluid sample inlet valve controllably movable selectively to open or close said inlet port, a second cylinder containing a second floating piston slidingly sealed thereto and dividing said second cylinder into a pressure transmitting chamber and a pressurisation reservoir for containing an elastic pressurisation source, a pressurisation control valve linking said second pressure transmitting chamber in said cylinder to said pressurisation chamber in said first cylinder, said limit valve, said inlet valve, and said pressurisation control valve being mutually linked for conjoint cascade operation, a regulator valve for controllably discharging fluid from said dashpot chamber, and regulator valve control means for actuating said regulator valve substantially at a predetermined time, whereby in operation of said tool wherein said tool is primed for well fluid sampling operation by said regulator valve being closed, said limit valve being opened to link said dashpot chamber and said pressurisation chamber, said inlet valve being opened, said pressurisation control valve being closed, said first floating piston being located in said first cylinder to be adjacent said well fluid inlet port to initialise the sample chamber volume at a minimum, said pressure transmitting chamber and said initially linked dashpot and pressurisation chambers each being substantially filled with a substantially incompressible hydraulic fluid, and said pressurisation reservoir being charged with an elastic pressurisation source having an initial pressure at least equal to the pressure of well fluid to be sampled, then when said tool is lowered down a well to a location where well fluid is to be sampled and upon said regulator valve control means opening said regulator valve controllably to discharge said hydraulic fluid from said dashpot chamber, the inherent pressure of reservoir fluid in said well causes well fluid to enter said sample chamber through said inlet port and so displace said first floating piston to accommodate incoming well fluid by enlarging the internal volume of said sample chamber at a rate controlled by the discharge of said hydraulic fluid from said pressurisation chamber through said limit valve, said dashpot chamber and said regulator valve, until said first floating piston reduces the internal volume of said pressurisation chamber to a minimum and contacts said limit valve to close said limit valve, then close said inlet valve and complete the intake of well fluid to said sample chamber, complete discharge of hydraulic fluid from said dashpot chamber and open said pressurisation control valve such that said elastic pressurisation source is now coupled through said second floating piston and the hydraulic fluid in said pressure transmitting and pressurisation chambers to apply pressurisation to said first floating piston in a manner tending to counteract thermal shrinkage of the sampled well fluid during cooling thereof by corresponding reduction of the internal volume of said sample chamber arising from pressurisation-induced movement of said first floating piston, to maintain said sampled well fluid in single-phase form.

2. A tool as claimed in claim 1, wherein said elastic pressurisation source is in the form of a compressed gas.

3. A tool as claimed in claim 2, wherein said gas is nitrogen.

4. A tool as claimed in claim 1, wherein the tool comprises an air chamber linked through said regulator valve to said dashpot chamber, said air chamber receiving said hydraulic fluid discharged through said regulator valve from said dashpot chamber in use of said tool.

5. A tool as claimed in claim 1, wherein said regulator valve control means comprises a signal receiving means for receiving an actuating signal transmitted at the time of sampling from the surface above the well whose fluid is being sampled.

6. A tool as claimed in claim 1, wherein said regulator valve control means comprises a clock or other timing device comprised within the tool and presettable at the surface prior to downwell deployment of the initialised tool.

7. A tool as claimed in claim 1, wherein said limit valve is in the form of an annular member and a plug member, said annular member being slidingly sealed to said first cylinder, said annular member being initially located in said first cylinder between said first floating piston and said plug member, said annular member being movable by contact with said first floating piston into sealed contact with said plug member to close said limit valve.

8. A tool as claimed in claim 7, wherein said plug member is linked through a link member to said inlet valve and to said pressurisation control valve to provide said mutual linkage thereof for conjoint cascade operation, said link member formed a combined mechanical force transmitting linkage and hydraulic conduit, said hydraulic conduit hydraulically linking said pressurisation control valve and said pressurisation chamber.

9. A tool as claimed in claim 7, wherein said pressurisation control valve is in the form of a pressure-balanced spool valve.

* * * * *